US009412317B2

(12) United States Patent
Tanaka et al.

(10) Patent No.: US 9,412,317 B2
(45) Date of Patent: Aug. 9, 2016

(54) DISPLAY DEVICE AND METHOD OF DRIVING THE SAME

(71) Applicant: Sharp Kabushiki Kaisha, Osaka-shi, Osaka (JP)

(72) Inventors: Noriyuki Tanaka, Osaka (JP); Kouji Kumada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 106 days.

(21) Appl. No.: 14/378,997

(22) PCT Filed: Feb. 28, 2013

(86) PCT No.: PCT/JP2013/055365

§ 371 (c)(1),
(2) Date: Aug. 15, 2014

(87) PCT Pub. No.: WO2013/140980

PCT Pub. Date: Sep. 26, 2013

(65) Prior Publication Data

US 2015/0009224 A1 Jan. 8, 2015

(30) Foreign Application Priority Data

Mar. 19, 2012 (JP) ..... 2012-062695

(51) Int. Cl.
*G09G 5/00* (2006.01)
*G09G 3/36* (2006.01)
*G09G 5/393* (2006.01)

(52) U.S. Cl.
CPC ..... *G09G 3/3611* (2013.01); *G09G 3/3648* (2013.01); *G09G 5/393* (2013.01); (Continued)

(58) Field of Classification Search
CPC ..... G09G 2330/021; G09G 3/3614; G09G 2340/0435; G09G 2310/08; G09G 2320/103; G09G 2310/02; G09G 2360/18; G09G 2310/0278; G09G 2310/04; G09G 2360/12; G09G 5/393; G06F 1/3265; G06F 3/1415
See application file for complete search history.

(56) References Cited

U.S. PATENT DOCUMENTS

2002/0093473 A1 7/2002 Tanaka et al.
2002/0180673 A1 12/2002 Tsuda et al.
(Continued)

FOREIGN PATENT DOCUMENTS

JP 2000-347762 A 12/2000
JP 2001-312253 A 11/2001
(Continued)

OTHER PUBLICATIONS

Official Communication issued in International Patent Application No. PCT/JP2013/055365, mailed on Apr. 23, 2013.

*Primary Examiner* — Hau Nguyen
(74) *Attorney, Agent, or Firm* — Keating & Bennett, LLP

(57) ABSTRACT

An object of the present invention is to provide a display device and a method of driving it, capable of displaying images properly even upon asynchronous input of image data while taking advantages of decreased power consumption implemented by intermission driving.

When there is an external input of new image data (image F) in a non-refreshing period in an intermission driving display device which performs intermittent refreshing based on the latest image data that is inputted in and read out from a frame memory, a coercive refreshing is started immediately based on the new image data (image F) (see the sixth frame period). Also, when there is an external input of image data (image G) during a refreshing period for the image F, the ongoing frame period including the refreshing of the image F is completed and immediately thereafter, a coercive refreshing based on the image data (image G) is started (see the ninth frame period).

13 Claims, 11 Drawing Sheets

(52) U.S. Cl.
CPC ..... *G09G2300/0478* (2013.01); *G09G 2300/0861* (2013.01); *G09G 2310/0278* (2013.01); *G09G 2310/08* (2013.01); *G09G 2320/0247* (2013.01); *G09G 2340/0435* (2013.01); *G09G 2360/08* (2013.01); *G09G 2360/12* (2013.01); *G09G 2360/18* (2013.01)

(56) References Cited

U.S. PATENT DOCUMENTS

| | | | |
|---|---|---|---|
| 2003/0020699 | A1 | 1/2003 | Nakatani et al. |
| 2004/0036669 | A1 | 2/2004 | Yanagi et al. |
| 2011/0233537 | A1 | 9/2011 | Shu et al. |
| 2011/0261043 | A1 | 10/2011 | Hayakawa et al. |

FOREIGN PATENT DOCUMENTS

| | | | |
|---|---|---|---|
| JP | 2002-140052 | A | 5/2002 |
| JP | 2002-278523 | A | 9/2002 |
| JP | 2003-044011 | A | 2/2003 |
| JP | 2004-078124 | A | 3/2004 |
| JP | 2005-037685 | A | 2/2005 |
| JP | 2011-242763 | A | 12/2011 |
| TW | 201133857 | A1 | 10/2011 |

FIG. 7

R : Refreshing
NR : Non-Refreshing (A)

| Frame Period | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| R/NR | R | NR | NR | R | NR | NR | R | NR | NR | R | NR | NR | R | NR | NR |
| Polarity | + | + | + | − | − | − | + | + | + | − | − | − | + | + | + |

(B)

Counter-Triggered Refreshing ⇩ Coercive Refreshing ⇩ Counter-Triggered Refreshing ⇩

| Frame Period | 16 | 17 | 18 | 19 | 20 | 21 | 22 | 23 | 24 | 25 | 26 | 27 | 28 | 29 |
|---|---|---|---|---|---|---|---|---|---|---|---|---|---|---|
| R/NR | R | NR | R | NR | NR | R | NR | NR | R | NR | NR | R | NR | NR |
| Polarity | − | − | + | + | + | − | − | − | + | + | + | − | − | − |

(C)

Counter-Triggered Refreshing ⇩ Coercive Refreshing ⇩ Counter-Triggered Refreshing ⇩

| Frame Period | 16 | 17 | 18 | 19 | 20 | 21 | 22 | 23 | 24 | 25 | 26 | 27 | 28 |
|---|---|---|---|---|---|---|---|---|---|---|---|---|---|
| R/NR | R | NR | R | NR | R | NR | NR | R | NR | NR | R | NR | NR |
| Polarity | − | − | + | + | − | − | − | + | + | + | − | − | − |

Adjustment Period

DISPLAY DEVICE AND METHOD OF DRIVING THE SAME

TECHNICAL FIELD

The present invention relates to display devices and methods of driving the same, and in particular to display devices which perform intermission driving, and to methods of driving these.

BACKGROUND ART

There has been constant demand for decreasing power consumption in display devices such as liquid crystal display devices. In response, Patent Document 1, for example, discloses a method of driving a display device, which includes an intermission period (also called "non-refreshing period") that follows a scanning period (also called "charging period" or "refreshing period") which is a period for refreshing a display image by scanning gate lines that serve as scanning signal lines in a liquid crystal display device. In the intermission period, all of the gate lines assume a non-scanning state and so the refreshing is not performed. During the intermission period, it is possible for example, not to supply control signals, etc. to a gate driver which serves as a scanning signal line drive circuit and/or to a source driver which serves as a data signal line drive circuit. Since this allows the gate driver and/or the source driver to stop operations thereof, the method makes it possible to decrease power consumption. The driving method such as the one disclosed in Patent Document 1, or the method in which a refreshing period is followed by a non-refreshing period (intermission period), is called "intermission driving" for example. The intermission driving is also called "low-frequency driving" or "intermittent driving". The intermission driving is suitable for displaying still images. Inventions related to intermission driving are disclosed in Patent Documents 2 through 5, etc., other than in Patent Document 1.

Generally, display devices which utilize intermission driving method can switch between normal driving where refreshing is performed at a rate of, e.g., 60 Hz or a higher frequency, and intermission driving where refreshing rate is lower than 60 Hz for example. This makes it possible to decrease power consumption appropriately according to the image which is to be displayed.

DOCUMENTS ON CONVENTIONAL ART

Patent Documents

Patent Document 1: JP-A 2001-312253 Gazette
Patent Document 2: JP-A 2000-347762 Gazette
Patent Document 3: JP-A 2002-278523 Gazette
Patent Document 4: JP-A 2004-78124 Gazette
Patent Document 5: JP-A 2005-37685 Gazette

SUMMARY OF THE INVENTION

Problems to be Solved by the Invention

In conventional liquid crystal display devices which perform such an intermission driving as described hereabove, it is impossible, when image data are inputted from the host during an intermission period, to begin writing pixel data into the liquid crystal display panel for making a display which represents said image data until the next refreshing period. In other words, it is impossible to refresh a display image based on said image data until the next refreshing period. Thus, when the user has issued a command for example, and the host has inputted image data in response, into the liquid crystal display during a non-refreshing period, a relatively long time is necessary before the display image is updated, and the user feels that the response is slow.

Such a problem will be avoided if a refreshing is started right away based on new image data without waiting for the next refreshing period if there is an asynchronous input of new image data from the host. There is a problem in this case, however, if the input of the new image data from the host is performed during a refreshing period in which a displayed image is being refreshed based on image data which are stored at a frame memory in the liquid crystal display device. When this happens, images of different frames are displayed in one screen, and therefore a discontinuous screen display, called tearing, is perceived. In an intermission driving, this tearing or a torn display continues during the next non-refreshing period, which poses a significant quality problem in display as compared to normal driving.

It is therefore an object of the present invention to provide a display device and a method of driving it, capable of displaying images properly even upon asynchronous input of image data while taking the advantages of decreased power consumption implemented by the intermission driving.

Means for Solving the Problems

The first aspect of the present invention provides a display device for display of an image represented by externally inputted image data. The device includes:

a display section for displaying the image;

a driving section for driving the display section;

a rewritable frame memory for storing the externally inputted image data; and a control section for controlling the frame memory and the driving section so as to write the externally inputted image data into the frame memory and to alternate between a refreshing period in which a display image is refreshed based on image data read out of the frame memory and a non-refreshing period in which the display image in the display section is not refreshed, wherein upon external input of new image data during the refreshing period, the control section controls the frame memory and the driving section so that the display image in the display section is refreshed based on the new image data before starting the next non-refreshing period.

The second aspect of the present invention provides the first aspect of the present invention, in which upon external input of the new image data during the refreshing period, the control section controls the frame memory and the driving section so that a current frame period in which the new input of image data has been made is completed and thereafter the display image in the display section is refreshed based on the new image data before starting the next non-refreshing period.

The third aspect of the present invention provides the second aspect of the present invention, in which upon external input of the new image data during the refreshing period, the control section:

starts writing of the new image data into the frame memory so that the writing of the new image data into the frame memory is completed after completion of reading of image data from the frame memory made for the refreshing in the current frame period; and starts reading of the new image data from the frame memory so that the writing of the new image data into the frame memory is completed before completion of the reading of the new image data from the frame memory.

The fourth aspect of the present invention provides the first aspect of the present invention, in which upon external input of the new image data during the refreshing period, the control section controls the frame memory and the driving section so that the refreshing period is aborted and then started based on the new image data.

The fifth aspect of the present invention provides the fourth aspect of the present invention, in which upon external input of the new image data during the refreshing period, the control section:

starts writing of the new image data into the frame memory; and starts reading of the new image data from the frame memory so that the writing of the new image data into the frame memory is completed before completion of the reading of the new image data from the frame memory.

The sixth aspect of the present invention provides the first aspect of the present invention, in which upon external input of new image data during the non-refreshing period, the control section controls the frame memory and the driving section so that the non-refreshing period is aborted and then the refreshing period is started based on the new image data.

The seventh aspect of the present invention provides the sixth aspect of the present invention, in which the display section displays an image represented by the image data by application of voltage signals representing the image data stored in the frame memory while cyclically inverting polarity of the voltage signals, and upon external input of the new image data during the non-refreshing period, the control section adjusts a length of the non-refreshing period which follows the refreshing of the display image in the display section that is performed based on the new image data so that the display section has substantially an equal length of time for a period in which the voltage signals applied have positive polarity and for a period in which the voltage signals applied have negative polarity.

The eighth aspect of the present invention provides one of the first through the seventh aspects of the present invention, in cases where the display section includes:

a plurality of scanning lines;

a plurality of signal lines crossing the plurality of scanning lines; and a plurality of pixel formation portions arranged in a matrix pattern corresponding to the plurality of scanning lines and the plurality of signal lines;

the driving section drives the plurality of scanning lines selectively, and drives the plurality of signal lines based on image data stored in the frame memory, and each pixel formation portion includes:

a switching element having a control terminal connected to a corresponding one of the scanning lines; and a predetermined capacitance connected to a corresponding one of the signal lines via the switching element.

The ninth aspect of the present invention provides the eighth aspect of the present invention, in which the switching element is provided by a thin film transistor having its channel layer formed of an oxide semiconductor.

A tenth aspect of the present invention provides a driving method of a display device which includes a display section for display of an image represented by externally inputted image data. The method includes:

a storing step of writing the externally inputted image data into a predetermined frame memory; and a driving step of driving the display section by alternation between a refreshing period in which a display image in the display section is refreshed based on image data read out of the frame memory and a non-refreshing period in which the display image in the display section is not refreshed, wherein the driving step includes: an asynchronous input driving step where, upon external input of new image data during the refreshing period, the display section is controlled so that the display image in the display section is refreshed based on the new image data before starting the next non-refreshing period.

Other aspects of the present invention will not be described here since they will be clear from the first through the tenth aspects of the present invention and descriptions of embodiments to be provided later.

Advantages of the Invention

According to the first aspect of the present invention, when there is an input of new image data during a refreshing period in a display device in which a refreshing period and a non-refreshing period are alternated with each other, i.e., in an intermission driving display device in which intermittent refreshing of the display image is performed, the display image in the display section is refreshed based on the new image before the next non-refreshing period is started. This makes it possible to reduce delay in updating the display image and suppress decrease in display quality caused by tearing at occasions when there is an asynchronous input of image data, while reducing power consumption by means of the intermittent driving.

According to the second aspect of the present invention, when there is an external input of new image data during a refreshing period, the ongoing frame period in which the new input of image data is made is completed and thereafter, a refreshing period based on the new image data is started before the next non-refreshing period is started. This ensures that a refreshing based on the new image data is started within one frame period, at the latest, following the time when there is the input of new image data. As a result of the refreshing, a displayed image is entirely based on the new image data and therefore, the arrangement suppresses delay in updating the display image and suppresses decrease in display quality at occasions when there is an asynchronous input of image data.

According to the third aspect of the present invention, when there is an input of new image data during a refreshing period, writing of the new image data into the frame memory is started at an appropriate timing to make sure that the new image data will not be read from the frame memory for the refreshing which is performed in the ongoing frame period, whereas reading of the new image data from the frame memory is started at an appropriate timing to make sure that the image data for the current refreshing which is performed in the ongoing frame period will not be read for the refreshing based on the new image data. This ensures reliable elimination of tearing which can be caused by an external input of new image data during a refreshing period, regardless of a difference between writing speed and reading speed to/from the frame memory.

According to the fourth aspect of the present invention, when there is an input of new image data during a refreshing period, the refreshing period is aborted, and a refreshing period is started based on the new image data. This ensures that a refreshing based on the new image data is started from the time when there is the input of new image data, and as a result of the refreshing, a displayed image is entirely based on the new image data. Therefore, the arrangement suppresses delay in updating the display image and suppresses decrease in display quality caused by tearing at occasions when there is an asynchronous input of image data.

According to the fifth aspect of the present invention, when there is an external input of new image data during a refreshing period, reading of the new image data from the frame memory is started at an appropriate timing to make sure that image data already stored in the frame memory at the time of input of the new image data are not read out for the refreshing based on the new image data. This ensures reliable elimination of tearing which can be caused by an external input of new image data during a refreshing period, regardless of a difference between writing speed and reading speed to/from the frame memory.

According to the sixth aspect of the present invention, when there is an external input of new image data during a non-refreshing period, the non-refreshing period is aborted, and a refreshing period is started based on the new image data. This makes it possible to reduce delay in updating the display image at occasions when there is an asynchronous input of image data in an intermission driving display device.

According to the seventh aspect of the present invention, a length of periods in which positive voltage signals are applied in the display section and a length of periods in which negative voltage signals are applied therein are substantially equal to each other even if there is an external input of image data in a non-refreshing period and the input is immediately responded by a refreshing based on the inputted image data, in an intermission driving. This eliminates problems such as flickering in the display image caused by imbalance in the positive period and the negative period in AC driving, and a problem of deterioration of liquid crystal in liquid crystal display devices.

The eighth aspect of the present invention provides the advantages offered by one of the first through the seventh aspects of the present invention, to voltage-control active matrix type display devices.

According to the ninth aspect of the present invention, a thin film transistor which has its channel layer formed of an oxide semiconductor is used as a switching element in each pixel formation portion in active matrix type display devices according to the eighth aspect of the present invention. This provides dramatic decrease in off-leak current in the thin film transistor, so the voltage which is written into a predetermined capacitance in each pixel formation portion is retained for a longer period of time.

Advantages of the other aspects of the present invention will not be described here since they will be clear from the advantages provided by the first through the ninth aspects of the present invention and description of embodiments to be given below.

BRIEF DESCRIPTION OF THE DRAWINGS

FIG. 7 is a set of diagrams showing polarity of voltages applied to a pixel capacitance in the liquid crystal display device according to the first embodiment. More specifically, FIG. 7(A) shows polarity of voltages applied to the pixel capacitance in a case where coercive refreshing is not performed; FIG. 7(B) shows polarity of voltages applied to the pixel capacitance in a case where a coercive refreshing is not followed by an adjustment period; and FIG. 7(C) shows polarity of voltages applied to a pixel capacitance in a case where the coercive refreshing is followed by an adjustment period.

MODE FOR CARRYING OUT THE INVENTION

Hereinafter, embodiments of the present invention will be described with reference to the attached drawings. In each of the following embodiments, the term "one frame" means a frame (16.67 ms) in a typical display device where a refreshing rate of 60 Hz is utilized.

1. First Embodiment

<1.1 Overall Configuration and Operation Outline>

Figure 1:
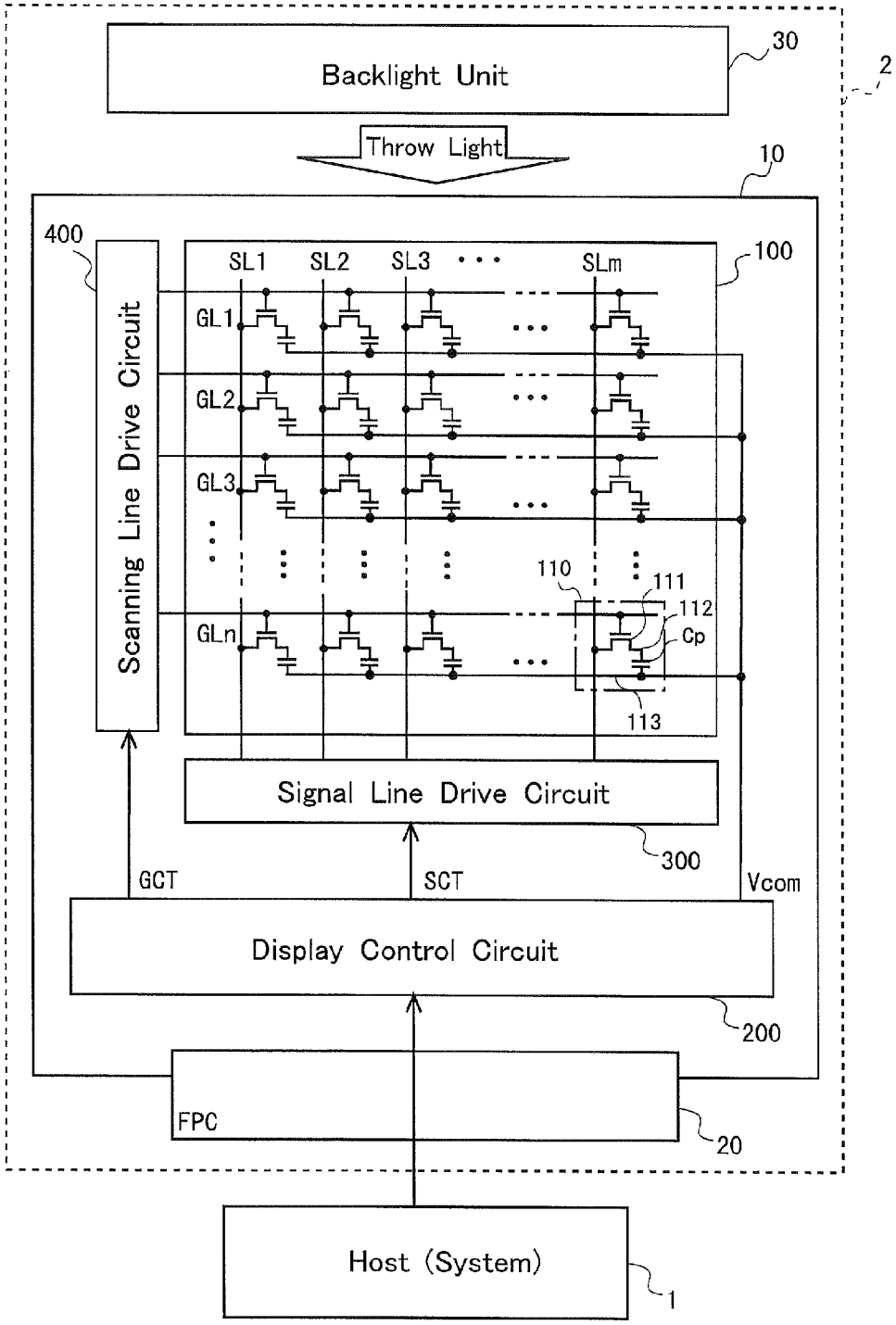
FIG. 1 is a block diagram showing a configuration of a liquid crystal display device according to a first embodiment of the present invention.

FIG. 1 is a block diagram showing a configuration of a liquid crystal display device 2 according to a first embodiment of the present invention. As shown in FIG. 1, the liquid crystal display device 2 includes a liquid crystal display panel 10 and a backlight unit 30. The liquid crystal display panel 10 includes an FPC (Flexible Printed Circuit) for external connection. Also, the liquid crystal display panel 10 includes a display section 100, a display control circuit 200, a signal line drive circuit 300 and a scanning line drive circuit 400. The signal line drive circuit 300 and the scanning line drive circuit 400 constitute a driving section in the present embodiment, and both or one of the signal line drive circuit 300 and the scanning line drive circuit 400 may be within the display control circuit 200. Also, both or one of the signal line drive circuit 300 and the scanning line drive circuit 400 may be integrally formed with the display section 100. Outside the liquid crystal display device 2, there is provided a host 1 (system) which is constituted mainly by a CPU.

The display section 100 is formed with a plurality (m) of signal lines SL1 through SLm, a plurality (n) of scanning lines GL1 through GLn, and a plurality (m×n) of pixel formation portions 110 disposed correspondingly to intersections made by the m signal lines SL1 through SLm and the n scanning lines GL1 through GLn. Hereinafter, when these m signal lines SL1 through SLm are not differentiated from each other, they will simply be called "signal lines SL"; likewise, when the n scanning lines GL1 through GLn are not differentiated from each other, they will simply be called "scanning lines GL". The m×n pixel formation portions 110 are formed in a matrix pattern. Each pixel formation portion 110 is constituted by: a TFT 111 which serves as a switching element having its gate terminal, serving as a control terminal, connected to one of the scanning lines GL that passes through the corresponding intersection while having its source terminal connected to one of the signal lines SL that passes through said intersection; a pixel electrode 112 connected to a drain terminal of the TFT 111; a common electrode 113 provided commonly to the m×n pixel formation portions 110; and a liquid crystal layer sandwiched between the pixel electrode 112 and the common electrode 113 and is common to these pixel formation portions 110. With the above, the pixel electrode 112 and the common electrode 113 form a liquid crystal capacitance, which functions as a pixel capacitance Cp. It should be noted here that typically, an auxiliary capacitance is provided in parallel to the liquid crystal capacitance for ensured voltage holding at the pixel capacitance Cp. Therefore, the pixel capacitance Cp is actually constituted by the liquid crystal capacitance and the auxiliary capacitance.

In the present embodiment, the TFT 111 is provided by one which includes, e.g., an oxide semiconductor as a channel layer (hereinafter such a TFT will be called "oxide TFT"). In more detail, the channel layer of the TFT 111 is made of IGZO (InGaZnOx) which is primarily constituted by indium (In), gallium (Ga), zinc (Zn), and oxygen (O). Hereinafter, a TFT which uses IGZO in its channel layer will be called "IGZO-TFT". The IGZO-TFT features remarkably smaller off-leak current than silicon TFTs which use amorphous silicon, for example, in their channel layers. Therefore, IGZO-TFTs are capable of holding a voltage which has been written into the pixel capacitance Cp for a longer time. It should be noted here that the same advantage can be obtained from other oxide semiconductors than IGZO, such as one which uses at least one of indium, gallium, zinc, copper (Cu), silicon (Si), tin (Sn), aluminum (Al), calcium (Ca), germanium (Ge), and lead (Pb) in its channel layer. It should also be noted here that using an oxide TFT as the TFT 111 represents only an example; it is acceptable that others such as a silicon TFT is used in place thereof.

The display control circuit 200 is typically implemented as an IC (Integrated Circuit). The display control circuit 200 receives data DAT from the host 1 via an FPC 20, and based thereon generates and outputs a signal line control signal SCT, a scanning line control signal GCT, and a common potential Vcom. The signal line control signal SCT is supplied to the signal line drive circuit 300. The scanning line control signal GCT is supplied to the scanning line drive circuit 400. The common potential Vcom is supplied to the common electrode 113. In the present embodiment, sending/receiving of the data DAT between the host 1 and the display control circuit 200 is performed via an interface which conforms to the DSI (Display Serial Interface) Standards proposed by MIPI (Mobile Industry Processor Interface) Alliance. The interface conforming to the DSI Standards enables high-speed data transmission. The present embodiment employs a video mode based on an interface conforming to the DSI Standards.

The signal line drive circuit 300 generates and outputs driving image signals to be supplied to the signal lines SL, based on the signal line control signal SCT. The signal line control signal SCT contains, for example, a digital image signal representing RGB data RGBD, a source start pulse signal, a source clock signal, a latch strobe signal, and a polarity switching signal. Based on the source start pulse signal, the source clock signal and the latch strobe signal, the signal line drive circuit 300 operates its unillustrated shift register and sampling latch circuit, etc., converts digital signals represented by the supplied digital image signal into analog signals with an unillustrated DA conversion circuit, and thereby generates driving image signals.

The scanning line drive circuit 400 repeats application of an active scanning signal to the scanning lines GL based on the scanning line control signal GCT. The scanning line control signal GCT contains, for example, a gate clock signal and a gate start pulse signal. The scanning line drive circuit 400 operates its unillustrated shift register, etc. based on the gate clock signal and gate start pulse signal, thereby generating scanning signals.

The backlight unit 30 is on the back side of the liquid crystal display panel 10, and irradiates the liquid crystal display panel 10 with backlight. The backlight unit 30 typically includes a plurality of LEDs (Light Emitting Diodes). The backlight unit 30 may be controlled by the display control circuit 200, or otherwise. If the liquid crystal display panel 10 is of a reflection type, then it is not necessary to have the backlight unit 30.

With the arrangement described above, the driving image signals are applied to the signal lines SL, the scanning signals are applied to the scanning lines GL, and the backlight unit 30 is driven, to display an image which corresponds to the image data sent from the host 1, in the display section 100 of the liquid crystal display panel 10.

<1.2 Display Control Circuit Configuration>

Figure 2:
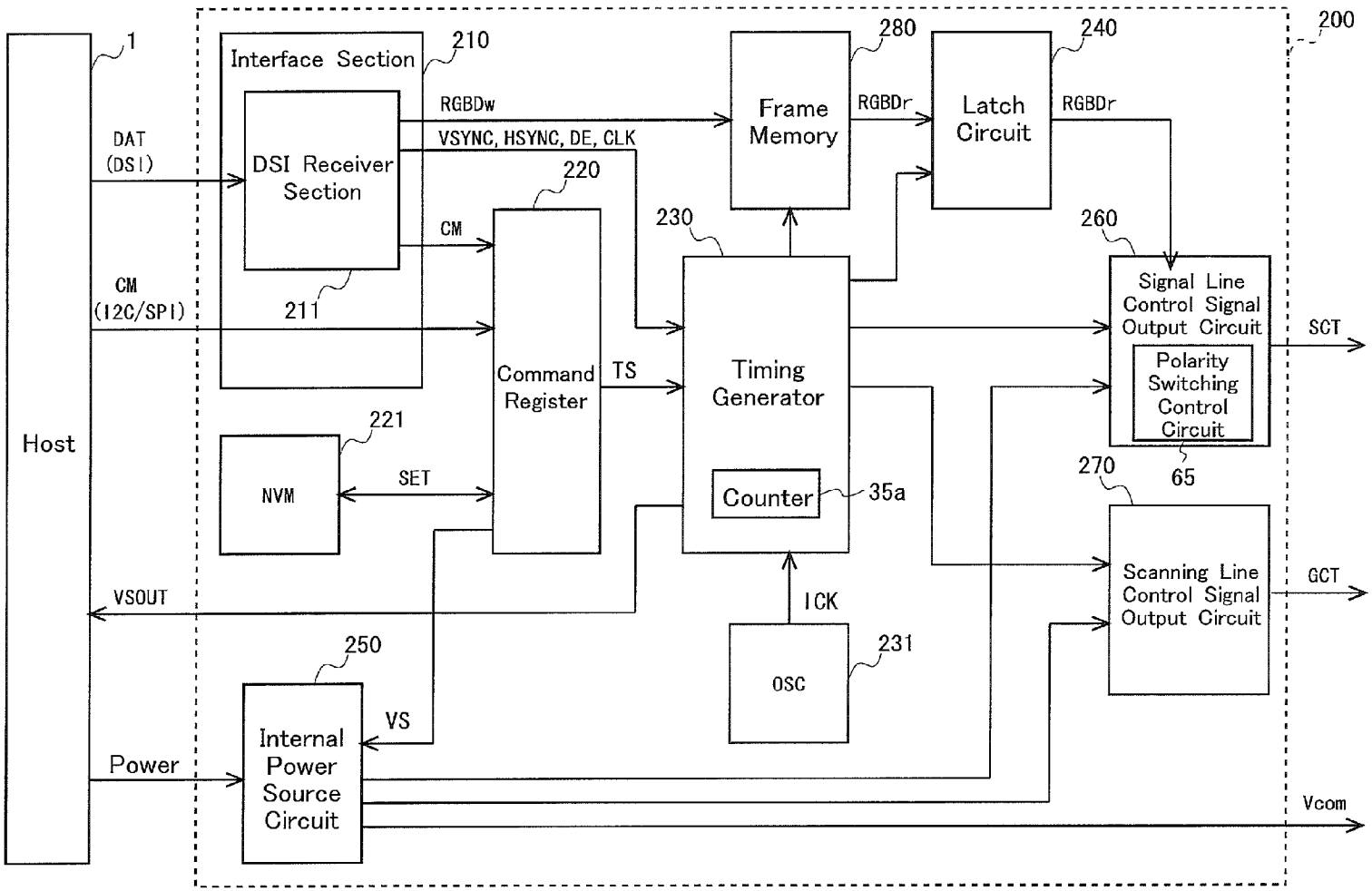
FIG. 2 is a block diagram showing a configuration (video mode RAM capture configuration) of a display control circuit in the first embodiment.

As has been described, the present embodiment makes use of a video mode based on an interface which conforms to the DSI Standards, and therefore the display control circuit 200 includes a RAM (Random Access Memory) as a frame memory (such a configuration is called "video mode RAM capture configuration"). FIG. 2 shows a configuration of the display control circuit 200 in the present embodiment described above, in the form of a block diagram. As shown in FIG. 2, the display control circuit 200 includes: an interface section 210, a command register 220, a NVM (Non-Volatile Memory) 221, a timing generator 230, an OSC (Oscillator) 231, a frame memory (RAM) 280, a latch circuit 240, an internal power source circuit 250, a signal line control signal output section 260, and a scanning line control signal output section 270. The interface section 210 includes a DSI receiver section 211. Also, as described earlier, both or one of the signal line drive circuit 300 and the scanning line drive circuit 400 may be provided within the display control circuit 200. It should be noted here that although the timing generator 230 can be regarded as a control section in the present invention, it is also possible to think that the display control circuit 200 represents a control section in the present invention in a case where the display control circuit 200 and the frame memory 280 are separated from each other.

The DSI receiver section 211 in the interface section 210 conforms to the DSI Standards. In the video mode, the data DAT include: RGB data RGBD which are image data that represent an image to be displayed; synchronization signals, i.e., a vertical synchronization signal VSYNC, a horizontal synchronization signal HSYNC, a data enable signal DE, and a clock signal CLK; and command data CM. The command data CM contain data for various control operations. Upon reception of the data DAT from the host 1, the DSI receiver section 211 supplies the RGB data RGBD which are included in the data DAT to the frame memory 280; supplies the vertical synchronization signal VSYNC, the horizontal synchronization signal HSYNC, the data enable signal DE, and the clock signal CLK to the timing generator 230; and the command data CM to the command register 220. In a different configuration which employs an interface conforming to the I2C (Inter Integrated Circuit) Standards or the SPI (Serial Peripheral Interface) Standards, the command data CM may be sent from the host 1 to the command register 220 via the interface. In this case, the interface section 210 includes a receiver section which conforms to the I2C Standards or the SPI Standards.

The command register 220 holds the command data CM. The NVM 221 stores a set of setting data SET for various control operations. The command register 220 reads the data SET stored in the NVM 221, and also updates the data SET according to the command data CM. The command register 220 supplies a timing control signal TS to the timing generator 230 and a voltage setting signal VS to the internal power source circuit 250, according to the command data CM and the setting data SET.

The timing generator 230 generates control signals based on an internal clock signal ICK generated in the OSC 231, depending on the vertical synchronization signal VSYNC, the horizontal synchronization signal HSYNC, the data enable signal DE, the clock signal CLK and the timing control signal TS, for controlling the frame memory 280, the latch circuit 240, the signal line control signal output section 260, and the scanning line control signal output section 270.

The frame memory 280 has a memory capacity capable of storing at least one frameful of RGB data RGBD, and holds the most recent frameful of RGB data RGBD sent from the host 1. The RGB data RGBD in the frame memory 280 is read out into the latch circuit 240 according to a control signal generated at the timing generator 230. The timing generator 230 generates a vertical synchronization output signal VSOUT based on the OSC 231 and sends to the host 1 according to the vertical synchronization signal VSYNC, the horizontal synchronization signal HSYNC, the data enable signal DE, the clock signal CLK and the timing control signal TS. The vertical synchronization output signal VSOUT is a signal which requests the host 1 to send data DAT.

Upon reception of the vertical synchronization output signal VSOUT (when the vertical synchronization output signal VSOUT assumes HIGH (active) level), the host 1 sends data DAT, if there is any to be sent to the display control circuit 200, within a time starting when the vertical synchronization output signal VSOUT becomes non-active and ending when a predetermined period has elapsed (within an image input detection period TIdt which will be described later). In addition to sending data DAT in synchronization with the vertical synchronization output signal VSOUT, the host 1 will also make sending of data DAT out of synchronization with the vertical synchronization output signal VSOUT. The display control circuit 200 according to the present embodiment is configured to be capable of handling such an asynchronous reception of data DAT, being able to refresh a display image based on the received data DAT.

The latch circuit 240 supplies the RGB data RGBD to the signal line control signal output section 260 under a control provided by the timing generator 230.

The internal power source circuit 250 generates and outputs a power source voltage and a common potential Vcom for use by the signal line controlling output section 260 and the scanning line control signal output section 270, based on electric power supplied from the host 1 and on a voltage setting signal VS supplied from the command register.

The signal line control signal output section 260 generates a signal line control signal SCT based on RGB data RGBD from the latch circuit 240, a control signal from the timing generator 230 and the power source voltage from the internal power source circuit 250, and supplies the generated signal to the signal line drive circuit 300. In the present embodiment, the display section 100 of the liquid crystal display panel 10 is AC driven, and for this feature, the signal line control signal SCT includes a polarity switching signal in order to invert polarities of the driving image signal from the signal line drive circuit 300. In order to generate the polarity switching signal based on the control signal from the timing generator 230, the signal line control signal output section 260 includes a polarity switching control section 65.

The scanning line control signal output section 270 generates and supplies a scanning line control signal GCT to the scanning line drive circuit 400, based on a control signal from the timing generator 230 and the source power voltage from the internal power source circuit 250.

The display control circuit 200 of a video mode RAM capture configuration is capable of holding RGB data RGBD in the frame memory 280, so there is no need for re-sending data DAT from the host 1 to the display control circuit 200 if there is no update of display image in the display section 100.

<1.3. Operation>

In the present embodiment, the frame memory 280 retains RGB data RGBD (hereinafter called "retained image data") which are a frameful of image data received most recently from the host 1, and this retained image data is utilized to display an image in the display section 100 during a time when there is no new RGB data RGBD supplied from the host 1 (i.e., while the display control circuit 200 does not receive data DAT from the host 1). During this, a pixel voltage held as a pixel data at the pixel capacitance Cp in each pixel formation portion 110 in the display section 100 is re-written at a predetermined cycle. Specifically, a display image in the display section 100 according to the present embodiment is refreshed at a predetermined cycle. Hereinafter, description will be made with a premise that this predetermined cycle, i.e., a refreshing cycle, has three frame periods, being composed of one frame period as a refreshing period followed by two frame periods as non-refreshing periods. It is also assumed that the term "one frame period", which means a period for refreshing a single screen, has the time length described earlier, i.e., the length of "one frame period" is a typical length of one frame (16.67 ms) in typical display devices where a refreshing rate of 60 Hz is utilized (the same applies to other embodiments which will be described later). It should be noted here that the refreshing cycle may be made of any number of periods as far as it is not shorter than two frame periods; a specific value thereof is determined with consideration, for example, into how often the host 1 will make an input of RGB data RGBD. For example, the refreshing cycle may be 60 frame periods, composed of 1 frame period as the refreshing period and the following 59 frame periods as the non-refreshing period. In this case, the refreshing rate is 1 Hz. Also, the refreshing period may be 2 frame periods or longer (the same applies to the other embodiments which will be described later).

In the present embodiment, the timing generator 230 includes a refreshing counter 35*a* for the purpose of cyclic refreshing based on the retained image data during the period while there are no RGB data RGBD inputted from the host 1 as descried earlier. This refreshing counter (hereinafter simply called "counter") 35*a* increases its count by an increment of one each time the vertical synchronization output signal VSOUT becomes active. Since the refreshing cycle is 3 frame periods, a value of "3" is pre-set as a refreshing execution counter value, so refreshing is performed when the count by the counter 35*a* is "3" (Hereinafter, this refreshing will be called "counter-triggered refreshing"). Also, in the present embodiment, when there is an asynchronous input of RGB data RGBD from the host 1, i.e., when the display control circuit 200 has received data DAT from the host 1 out of synchronization with the vertical synchronization output signal VSOUT, or when the display control circuit 200 has received data DAT from the host 1 while the counter 35*a* has not counted up to the refreshing execution counter value, the display image in the display section 100 is coercively refreshed in a midway of the refreshing cycle (hereinafter, this refreshing will be called "coercive refreshing"). Upon execution of a counter-triggered refreshing or a coercive refreshing, the count of the counter 35*a* is reset to "0". Once a coercive refreshing is performed, the timing generator 230 in the present embodiment takes this refreshing period in which said coercive refreshing is performed as a reference basis, and activates the vertical synchronization output signal VSOUT for a predetermined period per one frame period until a next coercive refreshing takes place.

In the present embodiment, two procedures are available for performing the coercive refreshing when there has been an asynchronous input of image data from the host 1 during a refreshing period. A first of the procedures is to continue the refreshing which has been going on at the time when the asynchronous input of the image data came from the host 1, and after completion of the refreshing, a coercive refreshing is performed immediately (without insertion of a non-refreshing period) based on the asynchronously inputted image data. A second choice of the procedures is to abort the ongoing refreshing upon the asynchronous input of image data from the host 1, and immediately perform a coercive refreshing based on the asynchronously inputted image data. In the present embodiment, selection between the first and the second procedures is made with a command from the host 1 or with a selection switch (not illustrated). The liquid crystal display device according to the present embodiment has two modes, i.e., a mode in which the coercive refreshing is performed in the first procedure (hereinafter this mode will be called "the first asynchronous input handling mode"), and a mode in which the coercive refreshing is performed in the second procedure (hereinafter called "the second asynchronous input handling mode").

<1.3.1 First Operation Example>

Figure 3:
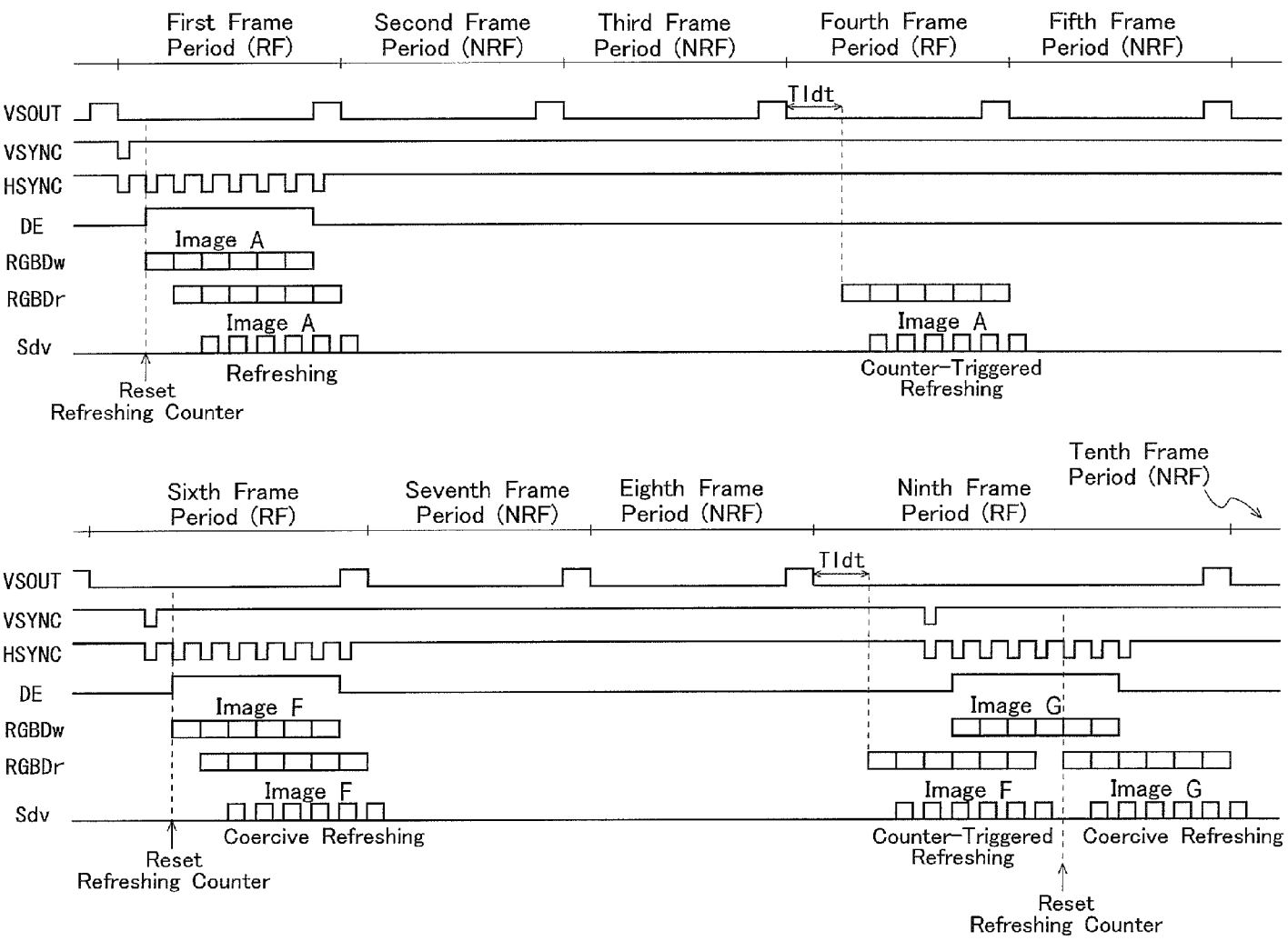
FIG. 3 is a timing chart of a first operation example (an operation example in a first asynchronous input handling mode) of the liquid crystal display device according to the first embodiment.
Figure 4:
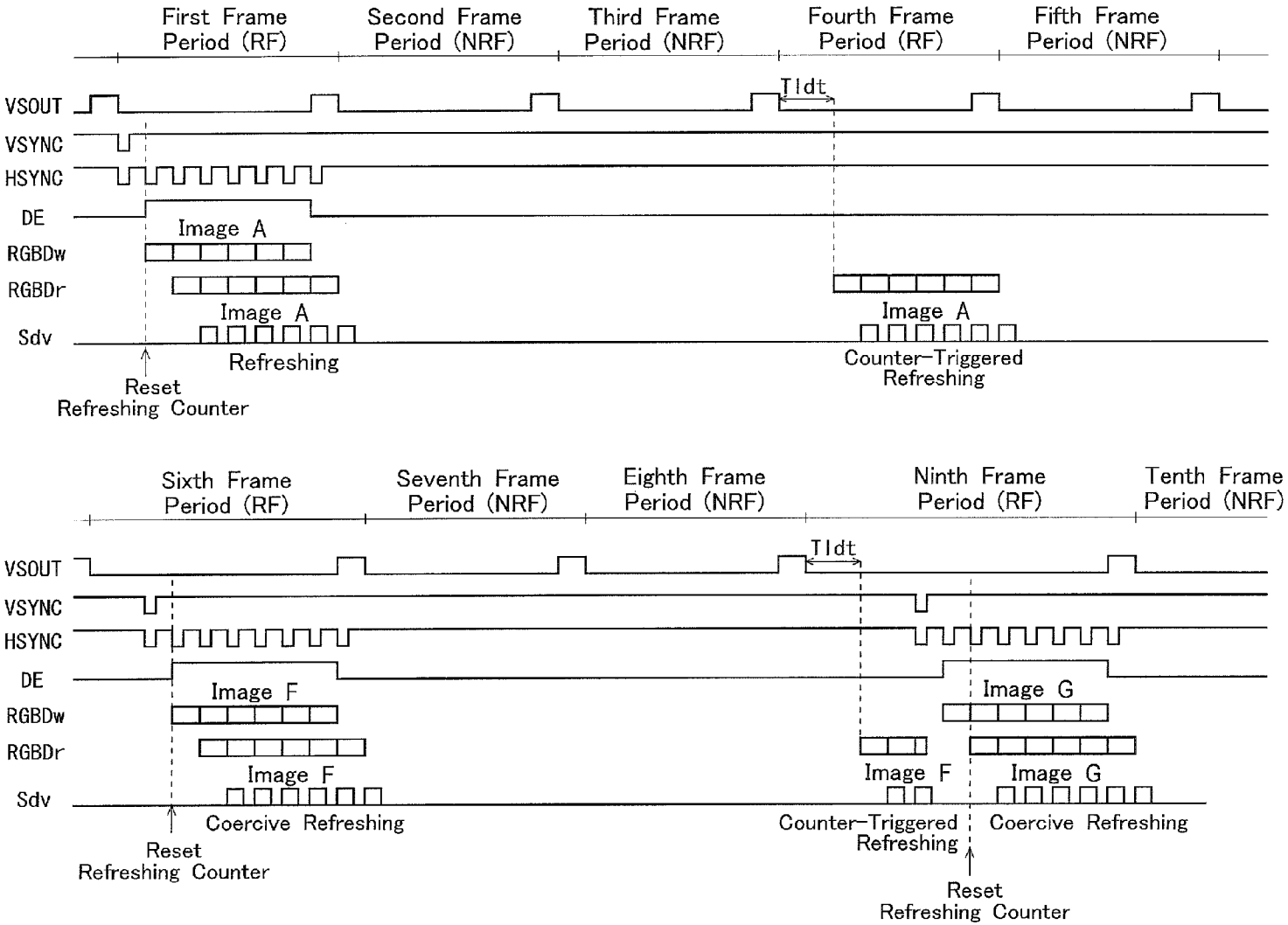
FIG. 4 is a timing chart of a second operation example (an operation example in a second asynchronous input handling mode) of the liquid crystal display device according to the first embodiment.

FIG. 3 is a timing chart which shows an operation example (hereinafter called the "first operation example") of a liquid crystal display device according to the present embodiment that performs a counter-triggered refreshing and a coercive refreshing as described thus far. In this example, data DAT from the host 1 are received in the first frame period in response to a request from the liquid crystal display device (from the display control circuit 200 thereof), whereby RGB data RGBD are inputted as image data. Also, in the sixth frame period and the ninth frame period, there is a new input of RGB data RGBD as new image data asynchronously from the host 1. FIG. 3 shows, from the top, the vertical synchronization output signal VSOUT; the vertical synchronization signal VSYNC; the horizontal synchronization signal HSYNC; the data enable signal DE; a signal which indicates RGB data RGBDw written into the frame memory 280 (thus, this signal will also be indicated as "RGBDw"); RGB data RGBDr read from the frame memory 280 and latched by the latch circuit 240 (thus, this signal will also be indicated as "RGBDr"); and driving image signal Sdv (the same will apply to FIG. 4 which will be described later). In FIG. 3, the vertical synchronization output signal VSOUT is a positive logic (Hi-active) signal, whereas the vertical synchronization signal VSYNC and the horizontal synchronization signal HSYNC are negative logic (Lo-active) signals (the same will apply to FIG. 4 which will be described later). Note also that although the liquid crystal display device is AC driven and therefore the driving image signal Sdv has its polarity switched in a predetermined cycle, none of FIG. 3 and FIG. 4 shows this polarity change in the driving image signal Sdv. The polarity switching of the driving image signal Sdv in AC driving will be described later.

At the beginning of the first frame period in FIG. 3, the timing generator 230 sends to the host 1 a vertical synchronization output signal VSOUT. Upon reception of the active vertical synchronization output signal VSOUT, the host 1 sends data DAT to the display control circuit 200. Specifically, upon receiving a vertical synchronization output signal VSOUT which becomes active (HIGH level) for a predetermined period, the host 1 sends control signals such as the vertical synchronization signal VSYNC to the liquid crystal display device in synchronization with a fall of the vertical synchronization output signal VSOUT. Also, in synchronization with a fall of a horizontal synchronization signal HSYNC, a data enable signal DE which indicates a range of valid RGB data rises from LOW level (L level) to HIGH level (H level), and while the data enable signal DE is in the H level, RGB data RGBDw of an image A are supplied to the frame memory 280.

In the first frame period, writing of the RGB data RGBDw of the image A into the frame memory 280 is started; thereafter, the RGB data RGBDw of the image A, which has been written into the frame memory 280 as RGB data RGBDr, are read according to a control signal sent from the timing generator 230 to the frame memory 280. The read RGB data RGBDr are supplied to the latch circuit 240, and temporarily stored at the latch circuit 240 according to a control signal supplied from the timing generator 230 to the latch circuit 240. These retained RGB data RGBDr are outputted together with a timing signal for the signal lines generated by the signal line control signal output section 260 based on a control signal from the timing generator 230, as a signal line control signal SCT from the signal line control signal output section 260, and supplied to the signal line drive circuit 300. Also, based on a control signal from the timing generator 230, a timing signal for the scanning lines which is generated by the scanning line control signal output section 270 is outputted from the scanning line control signal output section 270 to the scanning line drive circuit 400 as a scanning line control signal GCT. The signal line drive circuit 300 drives the signal lines SL of the display section 100 based on the signal line control signal SCT while the scanning line drive circuit 400 drives the scanning lines GL of the display section 100 based on the scanning line control signal GCT, whereby pixel data, each corresponding to part of an image represented by the RGB data RGBDr, are written to corresponding pixel formation portions 110 of the display section 100. Thus, based on the RGB data RGBDr of the image A which is newly inputted from the host 1, a refreshing is performed on the display image in the display section 100. Upon execution of the refreshing, the count in the counter 35*a* is reset to "0", and then incremented by 1 when entering the next frame period (the second frame period). Specifically, as shown in FIG. 3, the count in the counter 35*a* is reset when writing of the RGB data RGBDw into the frame memory 280 is started, and then incremented at a falling point of the vertical synchronization output signal VSOUT which assumed H level for a predetermined period after the writing.

In the second frame period, the counter 35*a* has a count of "1", so a counter-triggered refreshing is not performed. Since there is no input of mage data from the host 1, a coercive refreshing is not performed, either. Specifically, the second frame period is a non-refreshing period, and all the scanning lines GL1 through GLn assume de-selected state in this period. Therefore, pixel data written into each pixel formation portion 110 in the display section 100 during the refreshing period, i.e., the first frame period, is retained as it is. More specifically, a pixel voltage applied to each pixel capacitance Cp in the pixel formation portion 110 during the first frame period is retained as it is. At the end of the second frame period, the vertical synchronization output signal VSOUT assumes H level for a predetermined period and then falls to L level. This causes the count in the counter 35*a* to be incremented to "2", and the third frame period starts.

In the third frame period, the count of the counter 35*a* is "2", or has not reached the refreshing execution counter value ("3"), and so a counter-triggered refreshing is not performed. Since there is no input of mage data from the host 1, a coercive refreshing is not performed, either. Specifically, the third frame period is a non-refreshing period, too, continuing from the second frame period. At the end of the third frame period, the vertical synchronization output signal VSOUT assumes H level for a predetermined period and then falls down to L level, upon which the count in the counter 35*a* is incremented to "3", and the fourth frame period starts.

In the fourth frame period, the count in the counter 35*a* has already reached the refreshing execution counter value, i.e., "3". In this case, a counter-triggered refreshing is started unless there is an input of a vertical synchronization signal VSYNC from the host 1 to the display control circuit 200 within a pre-defined image input detection period TIdt after an active vertical synchronization output signal VSOUT is sent to the host 1 (i.e., after the vertical synchronization output signal VSOUT has fallen from H level to L level upon starting of the fourth frame period). It should be noted here that the image input detection period TIdt is sufficiently shorter than one frame period. In the example shown in FIG. 3, there is no input of a vertical synchronization signal VSYNC in the fourth frame period, so a counter-triggered refreshing is performed. Specifically, in the fourth frame period, the following process is performed to refresh the display image in the display section 100.

First, the image data retained in the frame memory 280, i.e., RGB data RGBDw, are read out as RGB data RGBDr from the frame memory 280 according to a control signal from the timing generator 230, and then temporarily stored in the latch circuit 240. These retained RGB data RGBDr are outputted to the signal line drive circuit 300 as a signal line control signal SCT from the signal line control signal output section 260 based on a control signal from the timing generator 230, together with a timing signal for the signal lines generated by the signal line control signal output section 260. Also, based on a control signal from the timing generator 230, a timing signal for the scanning lines which is generated by the scanning line control signal output section 270 is outputted from the scanning line control signal output section 270 to the scanning line drive circuit 400 as a scanning line control signal GCT. Then, the signal lines SL and the scanning lines GL in the display section 100 are driven by the signal line drive circuit 300 and the scanning line drive circuit 400 respectively, whereby the display image in the display section 100 is refreshed by using the image data retained in the frame memory 280. Specifically, a counter-triggered refreshing is executed. When the counter-triggered refreshing is started, the count in the counter 35*a* is reset to "0". At the end of the fourth frame period, the vertical synchronization output signal VSOUT assumes H level for a predetermined period and then falls down to L level, upon which the count in the counter 35*a* is incremented to "1", and the fifth frame period starts.

In the fifth frame period, the counter 35*a* has a count of "1", so a counter-triggered refreshing is not performed. Since there is no input of mage data from the host 1, a coercive refreshing is not performed, either. In other words, the fifth frame period is a non-refreshing period. Therefore, pixel data written into each pixel formation portion 110 in the display section 100 during the refreshing period, i.e., the fourth frame period, is retained as it is. At the end of the fifth frame period, the vertical synchronization output signal VSOUT assumes H level for a predetermined period and then falls down to L level, upon which the count in the counter 35*a* is incremented to "2", and the sixth frame period starts.

In the sixth frame period, the count of the counter 35*a* is "2", or has not reached the refreshing execution counter value ("3"), and so a counter-triggered refreshing is not performed. However, within this sixth frame period, the display control circuit 200 receives data DAT from the host 1; thus, RGB data RGBD as image data, a vertical synchronization signal VSYNC, a horizontal synchronization signal HSYNC, a data enable signal DE, and a clock signal CLK are inputted to the display control circuit 200. In the sixth frame period the count in the counter 35*a* has not yet reached the refreshing execution counter value, and there has been an asynchronous input of the RGB data RGBD as image data from the host 1. In response to this, a coercive refreshing is performed in the sixth frame period. Operations in this coercive refreshing is substantially the same as those in the first frame period:

First, the new image data inputted from the host 1, i.e., the RGB data RGBDw representing an image F, are written to the frame memory 280 according to a control signal which is generated by the timing generator 230 based on the vertical synchronization signal VSYNC, the horizontal synchronization signal HSYNC, the data enable signal DE, etc. from the host 1. After this writing is started, the image data of the image F written into the frame memory 280 is read out as RGB data RGBDr. The read RGB data RGBDr are then temporarily stored at the latch circuit 240. These retained RGB data RGBDr are outputted together with a timing signal for the signal lines generated by the signal line control signal output section 260, as a signal line control signal SCT from the signal line control signal output section 260, and supplied to the signal line drive circuit 300. Also, a timing signal for the scanning lines which is generated by the scanning line control signal output section 270 is outputted from the scanning line control signal output section 270 as a scanning line control signal GCT, and supplied to the scanning line drive circuit 400. Then, the signal lines SL and the scanning lines GL in the display section 100 are driven by the signal line drive circuit 300 and the scanning line drive circuit 400 respectively, whereby the display image in the display section 100 is refreshed by using the image data of the image F which is inputted from the host 1. Specifically, a coercive refreshing is executed. The coercive refreshing is not synchronous with the vertical synchronization output signal VSOUT; and a period from the time when the vertical synchronization output signal VSOUT became active (H level) immediately before this coercive refreshing, to the time when the signal will become active again is longer than a normal one frame period. Thereafter, the vertical synchronization output signal VSOUT becomes active for a predetermined period per one frame period, using this coercive refreshing period in the sixth frame period as a reference basis until a next coercive refreshing takes place. Also, in the sixth frame period, the count in the counter 35*a* is reset at a time point when writing of the RGB data RGBDw into the frame memory 280 is started, and then incremented after the writing when the vertical synchronization output signal VSOUT falls after it assumed H level for a predetermined period.

In the seventh frame period, the count in the counter 35*a* is "1", and there is no input of image data from the host 1, so the display control circuit 200 works the same way as it did in the second frame period. In the eighth frame period, the count in the counter 35*a* is "2", and there is no input of image data from the host 1, so the display control circuit 200 works the same way as it did in the third frame period. Therefore, the seventh and the eighth frame periods are non-refreshing periods.

In the ninth frame period, the count in the counter 35*a* has reached the refreshing execution counter value ("3"), and there is no input of a vertical synchronization signal VSYNC to the display control circuit 200 within the image input detection period TIdt which follows transmission of an active vertical synchronization output signal VSOUT to the host 1. Therefore, like in the fourth frame period, a counter-triggered refreshing is started based on the retained image data in the frame memory 280. However, during this counter-triggered refreshing, the interface section 210 in the display control circuit 200 receives data DAT from the host 1; thus, RGB data RGBD as image data of a new image G, a vertical synchronization signal VSYNC, a horizontal synchronization signal HSYNC, a data enable signal DE, and a clock signal CLK are inputted to the display control circuit 200. In the example shown in FIG. 3, the liquid crystal display device is operating in the first asynchronous input handling mode; therefore, the display control circuit 200 completes the ongoing counter-triggered refreshing within the ninth frame period and thereafter, starts a coercive refreshing based on the image data of the image G.

Specifically, once there is an asynchronous input of RGB data RGBDw as image data of an image G from the host 1 as described, the timing generator 230 of the display control circuit 200 controls the frame memory 280 so that reading of the image F RGB data RGBDr from the frame memory 280 will be made for continuous execution of the ongoing counter-triggered refreshing while writing of the image G RGB data RGBDw will be performed on the frame memory 280. Thereafter, upon completion of the counter-triggered refreshing, the display control circuit 200 controls the frame memory 280 so that the writing of the new image G RGB data RGBDw to the frame memory 280 will be continued while image data of the image G which have already been written to the frame memory 280 will be read out from the frame memory 280 as RGB data RGBDr.

The read RGB data RGBDr which have been read out from the frame memory 280 in this way are then temporarily stored at the latch circuit 240. These retained RGB data RGBDr are outputted together with a timing signal for the signal lines generated by the signal line control signal output section 260, as a signal line control signal SCT from the signal line control signal output section 260, and supplied to the signal line drive circuit 300. Also, a timing signal for the scanning lines which is generated by the scanning line control signal output section 270 is outputted from the scanning line control signal output section 270 as a scanning line control signal GCT, and supplied to the scanning line drive circuit 400. Then, the signal lines SL and the scanning lines GL in the display section 100 are driven by the signal line drive circuit 300 and the scanning line drive circuit 400 respectively, whereby the display image in the display section 100 is refreshed by using the image data of the image G which is inputted from the host 1. Specifically, a coercive refreshing is executed. The ninth frame period, in which the coercive refreshing is performed, becomes longer than the normal one frame period. Thereafter, the vertical synchronization output signal VSOUT becomes active for a predetermined period per one frame period, using this coercive refreshing period in the ninth frame period as a reference basis until a next coercive refreshing takes place. Also, in the ninth frame period where a coercive refreshing is executed, the count in the counter 35*a* is reset at a time point when reading of the image G RGB data RGBDr from the frame memory 280 is started, and then incremented upon completion of the reading when the vertical synchronization output signal VSOUT falls after it assumed H level for a predetermined period.

In the tenth frame period, the count in the counter 35*a* is "1", and there is no input of image data from the host 1, so the display control circuit 200 works the same way as it did in the second frame period and the seventh frame period and. In other words, the tenth frame period is a non-refreshing period.

<1.3.2 Second Operation Example>

FIG. 4 is a timing chart showing an operation example in the second asynchronous input handling mode (hereinafter called the "second operation example") of the liquid crystal display device according to the present embodiment. In this example again, data DAT are received from the host 1 in the first frame period in response to a request from the liquid crystal display device (from the display control circuit 200 thereof) whereby RGB data RGBD are inputted as image data; and an asynchronous input of RGB data RGBD as new image data is made in the sixth frame period and the ninth frame period. In the second operation example, operations of each component are identical with those in the first operation example, except for those in the ninth frame period. Therefore, description hereafter will only cover the operations of the components in the ninth frame period, without covering the operations in any other frame periods.

In the second operation example, too, the ninth frame period sees that the count in the counter 35*a* has reached the refreshing execution counter value ("3"), and there is no input of a vertical synchronization signal VSYNC to the display control circuit 200 within the image input detection period TIdt which follows transmission of an active vertical synchronization output signal VSOUT to the host 1. Therefore, like in the fourth frame period, a counter-triggered refreshing is started based on the retained image data in the frame memory 280. However, during this counter-triggered refreshing, the interface section 210 in the display control circuit 200 receives data DAT from the host 1; thus, there is an input of RGB data RGBD, i.e., image data that represent a new image G, a vertical synchronization signal VSYNC; a horizontal synchronization signal HSYNC, a data enable signal DE, and a clock signal CLK, to the display control circuit 200. In the second operation example, the liquid crystal display device operates in the second asynchronous input handling mode unlike in the first operation example. Therefore, the display control circuit 200 aborts the ongoing counter-triggered refreshing as shown in FIG. 4, upon input of the RGB data RGBD and other signals for the image G (in the example shown in FIG. 4, this abortion of the counter-triggered refreshing takes place at a time point when the vertical synchronization signal VSYNC, which fell down to L level after the counter-triggered refreshing started, rises to H level). Thereafter, the display control circuit 200 starts a coercive refreshing based on the image data of the image G.

Specifically, once there is an asynchronous input of RGB data RGBDw as image data of an image G from the host 1, the timing generator 230 of the display control circuit 200 controls the frame memory 280 so that reading of the image F RGB data RGBDr from the frame memory 280 will be aborted and writing of the new image G RGB data RGBDw will be performed on the frame memory 280. Also, the display control circuit 200 controls the frame memory 280 so that after this writing is started, the image data of the image G which is written into the frame memory 280 will be read out as RGB data RGBDr. The read RGB data RGBDr which have been read out from the frame memory 280 are then temporarily stored at the latch circuit 240. These retained RGB data RGBDr are outputted together with a timing signal for the signal lines generated by the signal line control signal output section 260, as a signal line control signal SCT from the signal line control signal output section 260, and supplied to the signal line drive circuit 300. Also, a timing signal for the scanning lines which is generated by the scanning line control signal output section 270 is outputted from the scanning line control signal output section 270 as a scanning line control signal GCT, and supplied to the scanning line drive circuit 400. Then, the signal lines SL and the scanning lines GL in the display section 100 are driven by the signal line drive circuit 300 and the scanning line drive circuit 400 respectively, whereby the display image in the display section 100 is refreshed by using the image data of the image G inputted from the host 1. Specifically, a coercive refreshing is executed. The ninth frame period, in which the coercive refreshing is performed, becomes longer than the normal one frame period (but shorter than the ninth frame period in the first operation example) and thereafter, the vertical synchronization output signal VSOUT becomes active for a predetermined period per one frame period, using this coercive refreshing period in the ninth frame period as a reference basis until a next coercive refreshing takes place. Also, in the ninth frame period where a coercive refreshing is executed, the count in the counter 35*a* is reset at a time point when reading of the image G RGB data RGBDr from the frame memory 280 is started, and then incremented upon completion of the reading when the vertical synchronization output signal VSOUT falls after it assumed H level for a predetermined period.

<1.4 Configuration and Operation of Scanning Line Drive Circuit>

Figure 5:
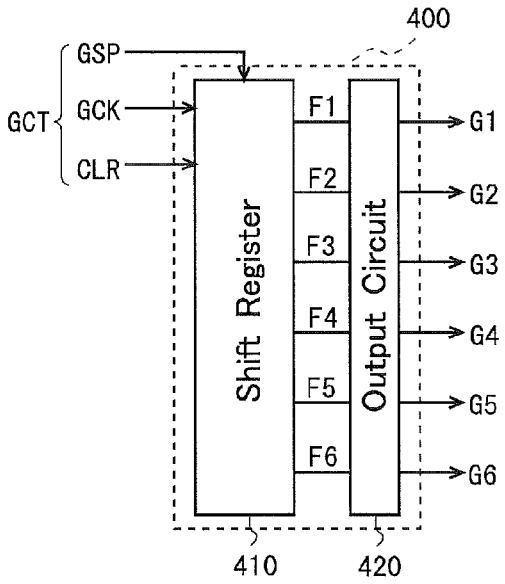
FIG. 5 is a block diagram for describing a configuration of a scanning line drive circuit necessary for operation in the second asynchronous input handling mode in the liquid crystal display device according to the first embodiment.

In order to execute the above-described coercive refreshing in the second asynchronous input handling mode, it is necessary that the scanning line drive circuit 400 aborts its sequential application of active scanning signals G1 through Gn to the scanning lines GL1 through GLn, i.e., scanning of the display section 100 by sequential selection of the scanning lines G11 through GLn, and de-activate all the scanning signals G1 through Gn, thereby bring all the scanning lines GL1 through GLn into a de-selected state. FIG. 5 depicts a configuration of the scanning line drive circuit 400 necessary for this coercive refreshing in the second asynchronous input handling mode, in the form of a block diagram. For the sake of descriptive convenience, FIG. 5 assumes that n=6, i.e. the number of scanning lines equals six (the same will apply to FIG. 6 which will be described later).

In the present embodiment, in order to handle the coercive refreshing in the second asynchronous input handling mode, the scanning line control signal GCT, which is supplied from the display control circuit 200 to the scanning line drive circuit 400, includes a clear signal CLR in addition to the gate start pulse signal GSP and the gate clock signal GCK. When the liquid crystal display device according to the present embodiment is operating in the second asynchronous input handling mode, and there is an asynchronous input of data DAT which include RGB data RGBD as image data from the host 1, the clear signal CLR assumes H level for a predetermined period based on a signal generated by the timing generator 230. On the other hand, when there is no asynchronous input of data DAT from the host 1, the clear signal stays in L level.

As shown in FIG. 5, the scanning line drive circuit 400 includes a shift register 410 and an output circuit 420. The above-mentioned gate start pulse signal GSP, the gate clock signal GCK, and the clear signal CLR are inputted to the shift registers 410. The shift register 410 is constituted by n (n=6) cascade-connected flip-flops, and makes sequential shifting of pulses which are contained in the gate start pulse signal GSP, from the first-stage flip-flop to the last-stage flip-flop in accordance with the gate clock signal GCK when the clear signal CLR is in L level. As a result, output signals F1 through F6 in respective stages of the shift register 410 become sequentially active (H level). These output signals F1 through F6 undergo level conversion by the output circuit 420, and then outputted as scanning signals G1 through G6. On the other hand, when the clear signal CLR assumes H level, all the flip-flops in the shift register 410 are reset; the output signals F1 through F6 in respective stages are all de-activated (L level), and as a result, all the scanning signals G1 through G6 also become non-active (L level).

Figure 6:
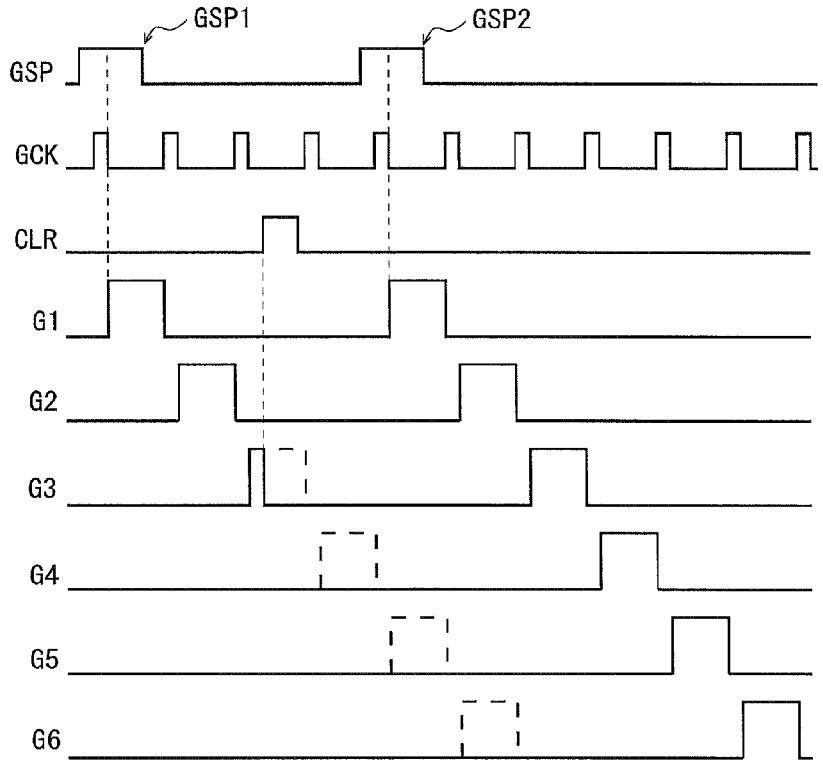
FIG. 6 is a timing chart for describing a function of the scanning line drive circuit necessary for operation in the second asynchronous input handling mode in the liquid crystal display device according to the first embodiment.

FIG. 6 is a timing chart which shows an operation example of the scanning line drive circuit 400 when the liquid crystal display device according to the present embodiment configured as the above is operating in the second asynchronous input handling mode. FIG. 6 shows an example, which is like the ninth frame period in FIG. 4, where a start pulse GSP1 contained in the gate start pulse signal GSP is shifted in accordance with the gate clock signal GCK up to the third-stage flip-flop of the shift register 410, and then upon elapse of a short time (which is shorter than one horizontal period) after the third scanning signal G3 has risen to H level, the clear signal assumes H level due to an asynchronous input of the image data. This resets all of the flip-flops in the shift registers 410, so all of the scanning signals G1 through G6 come to L level (FIG. 6 uses broken lines to indicate pluses of the scanning signals G3 through G6 which would be generated if there were not the asynchronous input of the image data, i.e., if the clear signal CLR stayed at L level).

After the clear signal CLR falls down from H level to L level, a start pulse GSP2 appears again in the gate start signal GSP in order to execute the coercive refreshing based on the asynchronously inputted image data (see the ninth frame period in FIG. 4). This start pulse GSP2 is sequentially shifted in the shift register 410, from the first-sage flip-flop toward the last-stage flip-flop in accordance with the gate clock signal GCK. This causes the scanning signals G1 through G6 to sequentially become active, to perform scanning of the display section 100 for the coercive refreshing based on the asynchronous input of the image data.

<1.5 AC Driving of Liquid Crystal Display Device>

FIG. 7 shows voltages applied across the pixel electrode 112 and the common electrode 113, or polarity of the voltage applied to the pixel capacitances Cp, in each frame period for implementing AC driving of the liquid crystal display device according to the present embodiment. More specifically, FIG. 7(A) shows polarities of the voltages applied to the pixel capacitance when a coercive refreshing is not performed; FIG. 7(B) shows polarities of the voltages applied to the pixel capacitance when a coercive refreshing is performed but is not followed by an adjustment period; and 7(C) shows polarities of the voltages applied to the pixel capacitance when a coercive refreshing is performed and is followed by an adjustment period. As has been described, in the present embodiment, the signal line control signal SCT includes a polarity switching signal which is generated by the polarity switching control circuit 65 in the display control circuit 200 and the signal line drive circuit 300 inverts the polarity of driving image signals which are to be applied to the signal lines SL1 through SLm in accordance with the polarity switching signal, whereby AC driving as shown in FIG. 7 is implemented.

First, reference will be made to FIG. 7(A), to describe a case where a counter-triggered refreshing is performed. In the present embodiment, a counter-triggered refreshing is performed every 3 frame periods if there is no asynchronous input of image data. Specifically, once a counter-triggered refreshing is performed, two frame periods of non-refreshing periods follow; in other words scanning of the display section 100 is not performed between the first one frame period (refreshing period) in which the counter-triggered refreshing is performed and the next one frame period (refreshing period) in which the next counter-triggered refreshing is to be performed. In the example shown in FIG. 7(A), the signal line drive circuit 300 controls driving image signal polarity in each refreshing period in accordance with the above-mentioned switching control signal, whereby positive voltages are applied to the pixel capacitances Cp till the third frame period; negative voltages are applied to the pixel capacitance Cp from the fourth frame period through the sixth frame period; and positive voltages are applied to the pixel capacitances Cp from the seventh frame period to the ninth frame period. Thereafter, the polarity of the driving image signals is inverted in the same pattern each time a counter-triggered refreshing is performed, whereby the polarity of the voltage applied to the pixel capacitance Cp is inverted for every three frame periods. FIG. 7(A) uses a reference symbol "R", which indicates a refreshing period, i.e., a period when the display section 100 is scanned. A reference symbol "NR" indicates a non-refreshing period, i.e., a period when the display section 100 is not scanned. Although FIG. 7 shows a counter-triggered refreshing which has a refreshing cycle of three frame periods composed of one frame period of refreshing (refreshing period) and two following periods (non-refreshing period) in which the display section 100 is not scanned, the refreshing cycle may be configured otherwise; for example, the length of the non-refreshing period may be one frame period, three frame periods, or longer.

Next, reference will be made to FIG. 7(B), to describe a case where there is an input of image data (asynchronous input of image data has taken place) while a counter-triggered refreshing is underway. As shown in FIG. 7(B), an image data is inputted asynchronously from the host 1 while the 18th frame period is underway; so a coercive refreshing is performed in the 18th frame period, the 19th and the 20th frame periods are non-refreshing periods, and so the display section 100 is not scanned. In this process, a negative voltage is applied to the pixel capacitance Cp in the 16th frame period and the 17th frame period, whereas a positive voltage is applied in the 18th frame period through the 20th frame period. This results in a difference between the length of the period when there is a positive voltage application and the length of the period when there is a negative voltage application over the time from the 16th frame period to the 20th frame. This leads to a potential problem of flickering, for example, in the image displayed in the display section 100. Also, in view of preventing deterioration of the liquid crystal, it is preferable that a total length of periods when positive voltages are applied to the liquid crystal should be equal, as much as possible, to a total length of periods when negative voltages are applied to the liquid crystal.

With the above in mind, reference will be made to FIG. 7(C), and description will be made for a method in which such a problem will not be caused in cases where there is an asynchronous input of image data while a counter-triggered refreshing is underway. Like the case in FIG. 7(B), a voltage of negative polarity is applied to the pixel capacitance Cp for two frame periods of the 16th frame period and the 17th frame period. Then, however, the 18th frame period and the 19th frame period are handled as adjustment periods, where the refreshing period, i.e., the 18th frame period, is followed by only one non-refreshing period, i.e., the 19th frame; and then in the 20th frame period that follows, image data stored in the frame memory 280 is read out as RGB data RGBDr, and a refreshing is performed based on these RGB data RGBDr. This means that the counter-triggered refreshing which would be performed in the 21st frame period is performed earlier by one frame period. By modifying the configuration of the display control circuit 200 (the timing generator 230 and the polarity switching control circuit 65 therein) so that such adjustment periods as described above will be implemented, the length of the period when there is a positive voltage application and the length of the period when there is a negative voltage application over the time from the 16th frame period to the 19th frame become equal to each other. As a result, the above-mentioned problems such as flickering in the image displayed in the display section 100 are eliminated, nor there is a problem of deterioration of the liquid crystal.

It should be noted here that the operation in FIG. 7(C) can be implemented by a configuration, for example, that the display control circuit 200 in the liquid crystal display device temporarily changes refreshing execution counter value in accordance with an asynchronous input of image data. Specifically, upon asynchronous input of image data, the count in the counter 35*a* (which is "2" in FIG. 7(C)) at this particular time point is temporarily set as the refreshing execution counter value, and then the refreshing execution counter value is changed to the original value of ("3") upon execution of the next refreshing. This makes the 18th frame period and the 19th frame period the adjustment periods in the example in FIG. 7(*c*), and so a counter-triggered refreshing takes place in the 20th frame period. After the 20th frame period, a counter-triggered refreshing takes place every three frame periods as the refreshing cycle if there is no asynchronous input of image data, and at each refreshing, polarity of the voltage applied to pixel capacitance Cp is inverted.

<1.6 Advantages>

According to the present embodiment described thus far, as long as there is no change in an image which is to be displayed, image data representing the image is supplied only once from the host 1 and stored in the frame memory 280; and thereafter, a displayed image in the display section 100 can be refreshed without receiving the image data from the host 1, but by using the stored image data retained in the frame memory 280 by way of intermittent counter-triggered refreshing, at a sufficiently lower refreshing rate than in conventional display devices. Consequently, it is possible to display images at remarkably less power consumption than conventionally when displaying still images or images which do not change much.

Also, according to the present embodiment, when there is an input of an image data from the host 1 asynchronously from the vertical synchronization output signal VSOUT which is generated at the display control circuit 200, i.e., when there is an input of new image data out of synchronization with the above-described intermittent counter-triggered refreshing cycle (refreshing cycle), a coercive refreshing is performed using the newly inputted image data by aborting an ongoing non-refreshing period if the new input is made during a non-refreshing period (see operations in the sixth frame period in FIG. 3 and FIG. 4). If the input is made during a refreshing period, a coercive refreshing is performed using the newly inputted image data before the next non-refreshing period is started. However, there are differences in component operations between when the liquid crystal display device is in the first asynchronous input handling mode and when it is in the second asynchronous input handling mode. Specifically, when there is an asynchronous input of new image data in a refreshing period under the first asynchronous input handling mode, the coercive refreshing based on the new image data is performed after the counter-triggered refreshing is completed in the refreshing period (see operation in the ninth frame period in FIG. 3). Therefore, there is no case where images of different frames are displayed in a single screen. On the other hand, when there is an asynchronous input of new image data in a refreshing period under the second asynchronous input handling mode, the ongoing refreshing is aborted, instead of replacing the old image data with the new image data for use in the refreshing, and a coercive refreshing is executed based on the new image data (see operations in the ninth frame period in FIG. 4). In this way, in whichever of the first and the second asynchronous input handling modes, the entire image displayed in the display section 100 is refreshed with the new image data before the next non-refreshing period is started. Therefore, it is possible to prevent occurrence of the phenomenon (tearing) where images of different frames are displayed in one screen and therefore a discontinuous screen display is perceived.

As understood from the above, according to the present embodiment, when there is an asynchronous input of new image data in an intermission driving liquid crystal display device which performs intermittent counter-triggered refreshing, the problem of tearing is prevented by execution of a coercive refreshing as described above, and in addition, updating of the display image is started immediately (within one frame period from the input of the new image data, at the latest). Therefore, it is possible to reduce delay in updating the display image and decrease in display quality at occasions when there is an asynchronous input of new image data, while reducing power consumption by means of the intermittent counter-triggered refreshing.

<1.7 Variations>

As has been described, in the first embodiment, it is selectable by means of a command from the host 1 or a predetermined setting on a particular switch (not illustrated), which of the first asynchronous input handling mode and the second asynchronous input handling mode will be used when there is an asynchronous input of image data during a refreshing period. However, there may be another configuration in which the procedure for the coercive refreshing started during a refreshing period is fixed to one, i.e., fixed to a first procedure according to the first asynchronous input handling mode or to a second procedure according to the second asynchronous input handling mode. It should also be noted here that although the first embodiment uses an arrangement that each refreshing period is one frame period, there may be arrangements where each refreshing period is made of two or more frame periods. In such an arrangement, when there is an asynchronous input of new image data during a refreshing period under an operation in the first asynchronous input handling mode, a coercive refreshing based on the new image data may be started upon completion of the frame period in which the image data are inputted; it is not necessary to wait till the end of the ongoing refreshing period before starting the coercive refreshing.

In the first embodiment, a coercive refreshing which is started during a refreshing period uses the first or the second procedure. Therefore, it is possible to prevent tearing which is caused by an asynchronous input of image data. However, in cases where there is a difference between a rate at which image data from the host 1 are written into the frame memory 280 as RGB data RGBDw (hereinafter simply called "writing speed") and a rate at which image data which are stored in the frame memory 280 are read out as RGB data RGBDr (hereinafter simply called "reading speed"), it is necessary in order to reliably avoid a chance for tearing, to adjust one or both of a start timing at which the writing of the RGB data RGBDw, i.e., the asynchronously inputted image data, into the frame memory 280 is started (hereinafter simply called "writing start timing") and a start timing at which the reading of the RGB data RGBDr, i.e., the asynchronously inputted image data, from the frame memory 280 (hereinafter simply called "reading start timing") is started. Hereinafter, description will cover a variation of the first embodiment modified from this view point.

Figure 8:
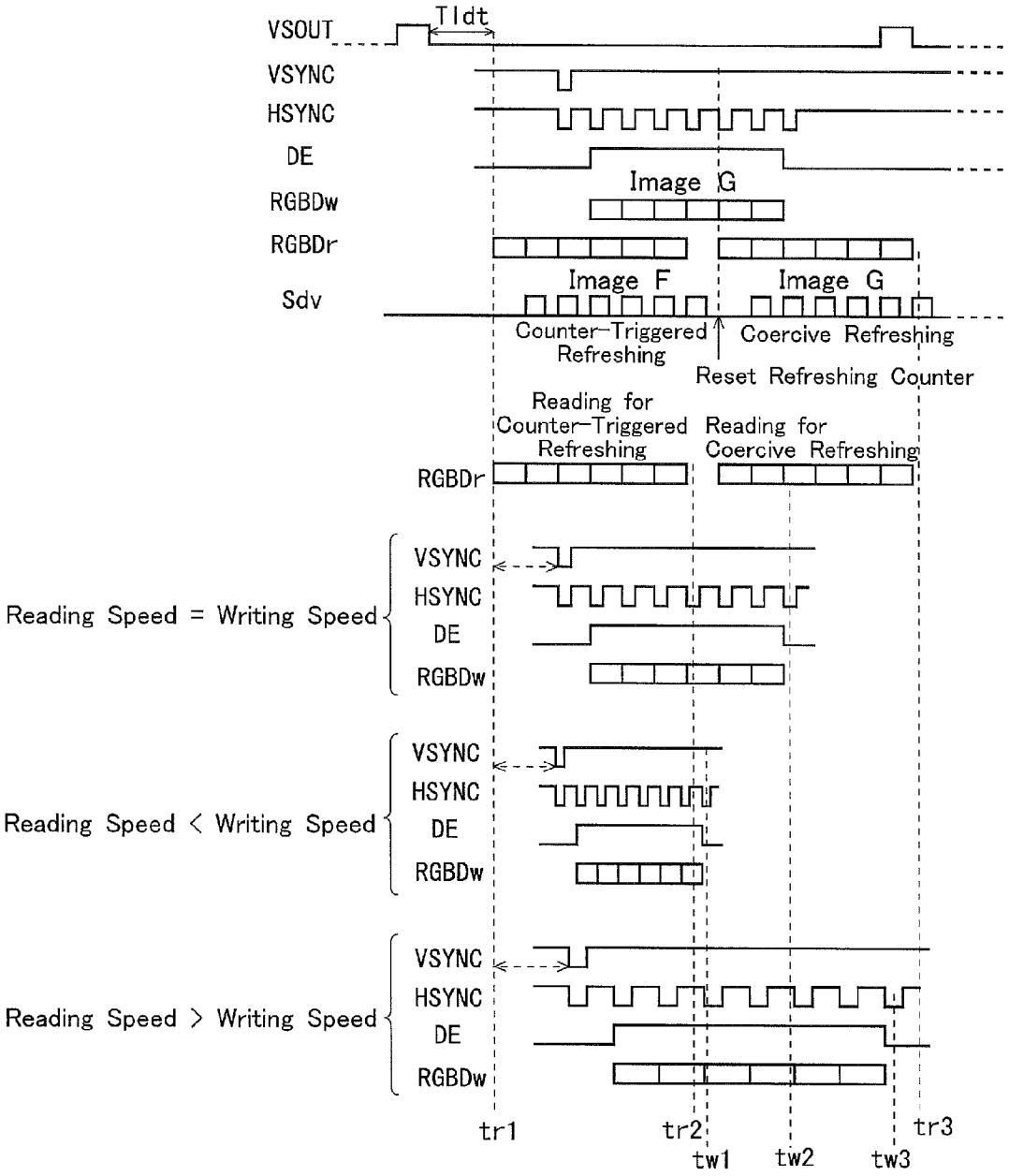
FIG. 8 is a timing chart for describing restrictions on writing to and reading from a frame memory in the first asynchronous input handling mode in the liquid crystal display device according to the first embodiment.

FIG. 8 is a timing chart for describing restrictions on writing to and reading from the frame memory 280 in the first asynchronous input handling mode in the liquid crystal display device according to the first embodiment. FIG. 8 illustrates how one or both of the writing start timing and the reading start timing should be adjusted in order to prevent tearing when there is an asynchronous input of image data during a refreshing period being performed for a counter-triggered refreshing in the first asynchronous input handling mode; for a case where the writing speed is equal to the reading speed; for a case where the writing speed is faster than the reading speed; and for a case where the writing speed is slower than the reading speed. Hereinafter, methods of the adjustment will be described with reference to FIG. 8.

If the reading speed is equal to the writing speed, reading of RGB data RGBDr (image F) for counter-triggered refreshing (hereinafter simply called "reading for counter-triggered refreshing") is started at a start time tr1 and thereafter, writing of the asynchronously inputted image data (image G) (hereinafter called "writing for coercive refreshing") is started and thereafter, reading of RGB data RGBDr (image G) for coercive refreshing (hereinafter simply called "reading for coercive refreshing") is started, so that the writing for coercive refreshing is completed before the reading for coercive refreshing is completed at a finish time tr3 (tw2<tr3). As will be understood from the description thus far, these conditions regarding the writing to and reading from the frame memory 280 are satisfied in the display control circuit 200 according to the first embodiment. Satisfying these conditions ensures that only the image F will be displayed by the counter-triggered refreshing while only the image G will be displayed by the coercive refreshing.

If the writing speed is faster than the reading speed, it is necessary to adjust the writing start timing in accordance with the reading speed and the writing speed so that the writing for coercive refreshing will be started after the reading for counter-triggered refreshing is started at the start time tr1 whereas the writing for coercive refreshing will be completed after the reading for counter-triggered refreshing is completed at a finish time tr2 (tr2<tw1). Specifically, the timing generator 230 in the display control circuit 200 must be arranged for controlling the frame memory 280 in such a timing adjustment as described. Regarding this, the first embodiment should have an arrangement that the writing for coercive refreshing is started at a timing which leads the writing for coercive refreshing to its completion after the reading for counter-triggered refreshing is completed. This arrangement ensures that only the image F will be displayed by the counter-triggered refreshing while only the image G will be displayed by the coercive refreshing.

If the writing speed is slower than the reading speed, it is necessary to adjust the writing start timing and the reading start timing in accordance with the reading speed and the writing speed so that the writing for coercive refreshing will be started after the reading for counter-triggered refreshing is started at the start time tr1, whereas the writing for coercive refreshing will be completed before the reading for coercive refreshing is completed at a finish time tr3 (tw3<tr3). Specifically, the timing generator 230 in the display control circuit 200 must be arranged for controlling the frame memory 280 in such a timing adjustment as described. Regarding this, the first embodiment should have an arrangement that the reading for coercive refreshing is started at a timing which leads the writing for coercive refreshing to its completion before the reading for coercive refreshing is completed. This arrangement ensures that only the image F will be displayed by the counter-triggered refreshing while only the image G will be displayed by the coercive refreshing.

For the first asynchronous input handling mode, therefore, the necessary arrangement is that the frame memory 280 is controlled to adjust one or both of the writing start timing and the reading start timing depending on the reading speed and the writing speed as described above. Taking into account all of the above-described three cases regarding the reading speed and the writing speed, a necessary arrangement for the first asynchronous input handling mode is that in the first embodiment, the writing for coercive refreshing is started so that the writing for coercive refreshing will be completed after the reading for counter-triggered refreshing is completed; and the reading for coercive refreshing is started so that the writing for coercive refreshing will be completed before the reading for coercive refreshing is completed. The above-described arrangement ensures that only the image F will be displayed by the counter-triggered refreshing while only the image G will be displayed by the coercive refreshing, without resulting in tearing.

Figure 9:
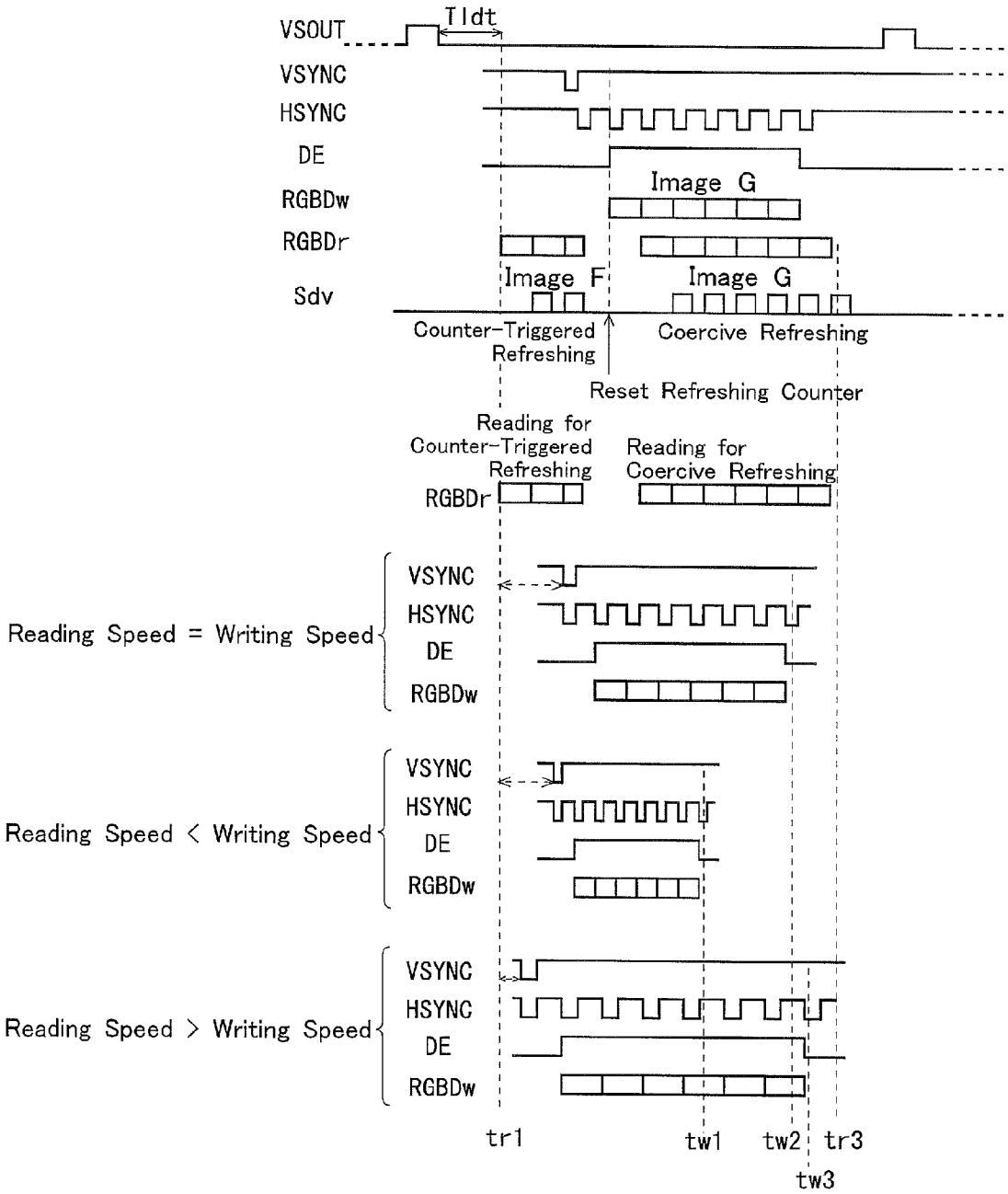
FIG. 9 is a timing chart for describing restrictions on writing to and reading from a frame memory in the second asynchronous input handling mode in the liquid crystal display device according to the first embodiment.

FIG. 9 is a timing chart for describing restrictions from the writing speed and the reading speed in the second asynchronous input handling mode in the liquid crystal display device according to the first embodiment. FIG. 9 illustrates how one or both of the writing start timing and the reading start timing should be adjusted in order to prevent tearing when there is an asynchronous input of image data during a refreshing period being performed for a counter-triggered refreshing in the second asynchronous input handling mode; for a case where the writing speed is equal to the reading speed; for a case where the writing speed is faster than the reading speed; and for a case where the writing speed is slower than the reading speed. Hereinafter, methods of the adjustment will be described with reference to FIG. 9.

If the reading speed is equal to the writing speed, the writing for coercive refreshing (writing of the image G RGB data RGBDw) is started after the reading for counter-triggered refreshing (reading of the image F RGB data RGBDr) is started at a start time tr1 and thereafter, the reading for coercive refreshing (reading of the image G RGB data RGBDr) is started, so that the writing for coercive refreshing is completed before the reading for coercive refreshing is completed at a finish time tr3 (tw2<tr3). As will be understood from the description thus far, these conditions regarding the writing to and reading from the frame memory 280 are satisfied in the display control circuit 200 according to the first embodiment. Satisfying these conditions ensures that only the image G will be displayed by the coercive refreshing.

If the writing speed is faster than the reading speed, it is necessary to adjust the writing start timing and the reading start timing in accordance with the reading speed and the writing speed so that the writing for coercive refreshing will be started after the reading for counter-triggered refreshing is started at the start time tr1 and thereafter, the reading for coercive refreshing is started whereby the writing for coercive refreshing will be completed before the reading for coercive refreshing is completed at a finish time tr3 (tw1<tr3). Specifically, the timing generator 230 in the display control circuit 200 must be arranged for controlling the frame memory 280 in such a timing adjustment as described. Regarding this, the first embodiment should have an arrangement that the reading for coercive refreshing is started at a timing which leads the writing for coercive refreshing to its completion before the reading for coercive refreshing is completed. This arrangement ensures that only the image G will be displayed by the coercive refreshing.

If the writing speed is slower than the reading speed, it is necessary to adjust the writing start timing and the reading start timing in accordance with the reading speed and the writing speed so that the writing for coercive refreshing will be started after the reading for counter-triggered refreshing is started at the start time tr1 whereas the writing for coercive refreshing will be completed before the reading for coercive refreshing is completed at a finish time tr3 (tw3<tr3). Specifically, the timing generator 230 in the display control circuit 200 must be arranged for controlling the frame memory 280 in such a timing adjustment as described. Regarding this, the first embodiment should have an arrangement that the reading for coercive refreshing is started at a timing which leads the writing for coercive refreshing to its completion before the reading for coercive refreshing is completed. This arrangement ensures that only the image G will be displayed by the coercive refreshing.

For the second asynchronous input handling mode therefore, the necessary arrangement is that the frame memory 280 is controlled to adjust one or both of the writing start timing and the reading start timing depending on the reading speed and the writing speed as described above. Taking into account all of the above-described three cases regarding the reading speed and the writing speed, a necessary arrangement for the second asynchronous input handling mode is that in the first embodiment, the reading for coercive refreshing is started so that the writing for coercive refreshing will be completed before the reading for coercive refreshing is completed. This arrangement ensures that only the image G will be displayed by the coercive refreshing, without resulting in tearing.

2. Second Embodiment

Next, description will cover a liquid crystal display device according to a second embodiment of the present invention.

This liquid crystal display device has an overall configuration which is the same as of the first embodiment, i.e., as in FIG. 1. Therefore, the same components will be indicated with the same reference symbols and their description will not be repeated. Hereinafter, description will cover a configuration of the display control circuit 200 in the present embodiment, and an operation of the liquid crystal display device based on the configuration.

<2.1 Display Control Circuit Configuration>

Figure 10:
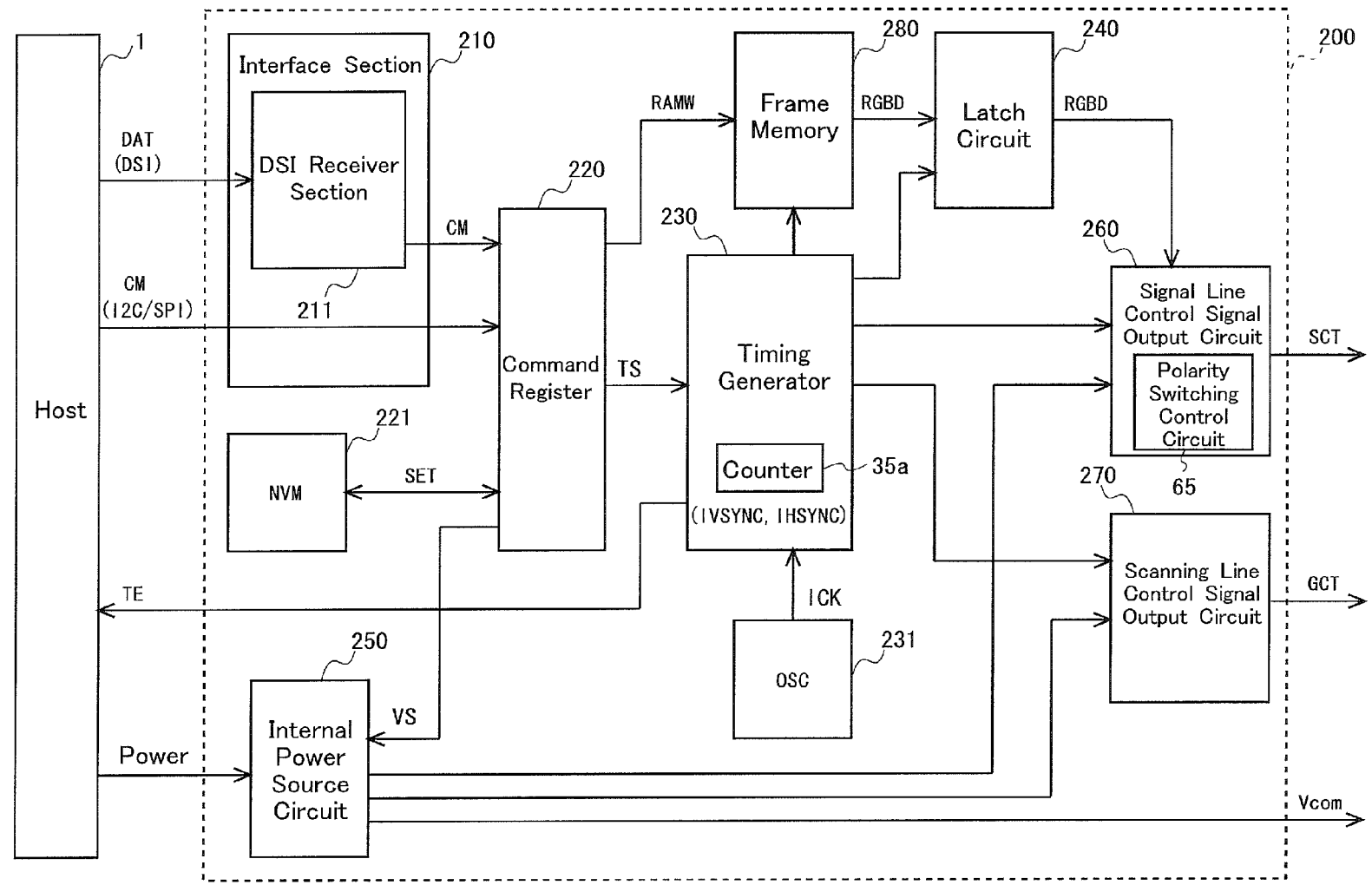
FIG. 10 is a block diagram showing a configuration (command mode RAM write configuration) of a display control circuit in a liquid crystal display according to a second embodiment of the present invention.

The present embodiment makes use of a command mode based on an interface which conforms to the DSI Standards, and therefore the display control circuit 200 includes a RAM (Random Access Memory) as a frame memory (such a configuration is called "command mode RAM write configuration"). FIG. 10 shows a configuration of the display control circuit 200 in the present embodiment described above, in the form of a block diagram. As shown in FIG. 10, the display control circuit 200 includes the same constituent elements as the earlier-described display control circuit 200 (FIG. 2) of the video mode RAM capture configuration according to the first embodiment. Therefore, the same or corresponding elements will be indicated with the same reference symbols and their description will not be repeated here. The present embodiment differs from the first embodiment in terms of data included in data DAT which are inputted from the host 1 to the display control circuit 200.

Data DAT in the command mode contains command data CM, but does not contain RGB data RGBD, a vertical synchronization signal VSYNC, a horizontal synchronization signal HSYNC, a data enable signal DE, or a clock signal CLK. However, the command data CM in the command mode contains data relevant to an image, and data relevant to various timings. Upon reception of the data DAT from the host 1, the DSI receiver section 211 supplies the command data CM to the command register 220. The command register 220, supplies to the frame memory 280 RAM write-data RAMW, i.e., a portion of the command data CM which is relevant to the image. The RAM write-data RAMW are an equivalent to the RGB data RGBD. In the command mode, the timing generator 230 does not receive a vertical synchronization signal VSYNC or a horizontal synchronization signal HSYNC, but internally generates an internal vertical synchronization signal IVSYNC and an internal vertical synchronization signal IHSYNC, based on an internal clock signal ICK and a timing control signal TS. Based on these internal vertical synchronization signal IVSYNC and the internal vertical synchronization signal IHSYNC, the timing generator 230 controls the latch circuit 240, the signal line control signal output section 260, and the scanning line control signal output section 270. Also, the timing generator 230 sends to the host 1 a transmission control signal TE which is an equivalent of the vertical synchronization output signal VSOUT in the first embodiment.

<2.2 Operation>

In the present embodiment, the frame memory 280 retains RAM write-data RAMW (hereinafter called "retained image data") which are a frameful of image data received most recently from the host 1, and this retained image data is utilized to display an image in the display section 100 during a time when there is no new reception of RAM write-data RAMW from the host 1 (while the display control circuit 200 does not receive data DAT from the host 1). During this, a pixel voltage held as a pixel data at the pixel capacitance Cp in each pixel formation portion 110 in the display section 100 is re-written at a predetermined cycle. Specifically, a display image in the display section 100 according to the present embodiment is refreshed at a predetermined cycle. Again, in the present embodiment, description will be made with a premise that this refreshing cycle has a length of three frame periods, composed of one frame period as a refreshing period followed by two frame periods as non-refreshing periods. It should be noted here that the refreshing cycle may be made of any number of periods as far as it is not shorter than two frame periods; a specific value thereof is determined with consideration, for example, to how often the host 1 will make an input of RAM write-data RAMW.

In the present embodiment, the timing generator 230 includes a counter 35*a* for the purpose of cyclic refreshing based on the retained image data during the period while no RAM write-data RAMW is inputted from the host 1 as descried earlier. The counter 35*a* increases its count by an increment of one each time the transmission control signal TE becomes active. Since the refreshing cycle is 3 frame periods, a value of "3" is preset as a refreshing execution counter value, so refreshing is performed when the count in the counter 35*a* is "3" (this refreshing is called "counter-triggered refreshing"). Also, in the present embodiment, when there is an asynchronous input of RAM write-data RAMW from the host 1, i.e., when the display control circuit 200 has received data DAT from the host 1 out of synchronization with the transmission control signal TE, or when the display control circuit 200 has received data DAT from the host 1 while the counter 35*a* has not counted up to the refreshing execution counter value, the display image in the display section 100 is coercively refreshed in a midway of the refreshing cycle (this refreshing is called "coercive refreshing"). Upon execution of a counter-triggered refreshing or a coercive refreshing, the count of the counter 35*a* is reset to "0". Once a coercive refreshing is performed, the timing generator 230 in the present embodiment takes this refreshing period in which said coercive refreshing is performed as a reference basis, and activates the transmission control signal TE for a predetermined period per one frame period until a next coercive refreshing takes place.

In the present embodiment, the first and the second procedures are available like in the first embodiment, for performing the coercive refreshing when there has been an asynchronous input of image data from the host 1 during a refreshing period. Selection between the first and the second procedures is made with a command from the host 1 or with a selection switch (not illustrated). Also, like in the first embodiment, the liquid crystal display device according to the present embodiment has the first asynchronous input handling mode in which the coercive refreshing is performed in the first procedure, and the second asynchronous input handling mode in which the coercive refreshing is performed in the second procedure.

<2.2.1 First Operation Example>

Figure 11:
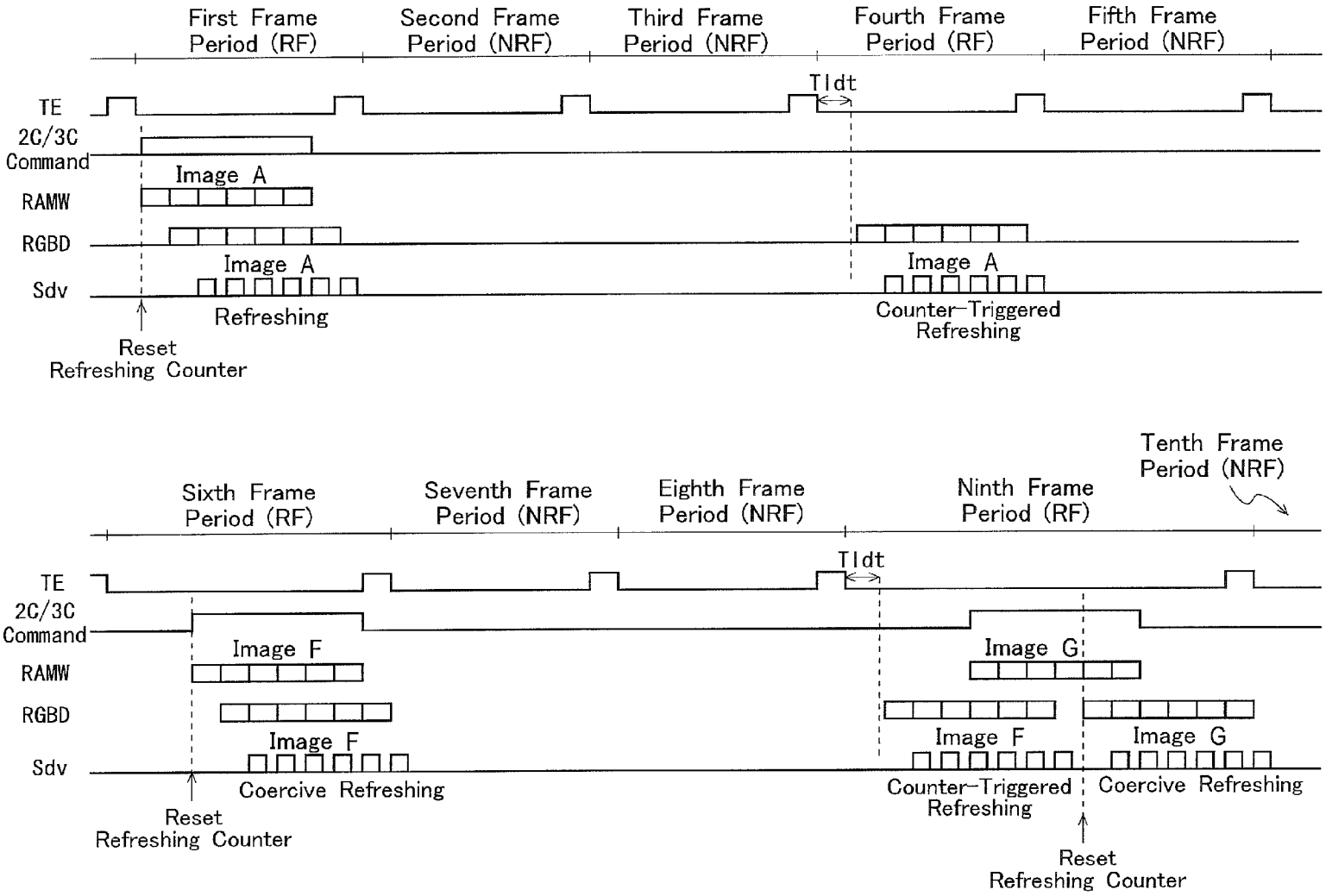
FIG. 11 is a timing chart of a first operation example (operation example in a first asynchronous input handling mode) of the liquid crystal display device according to the second embodiment.
Figure 12:
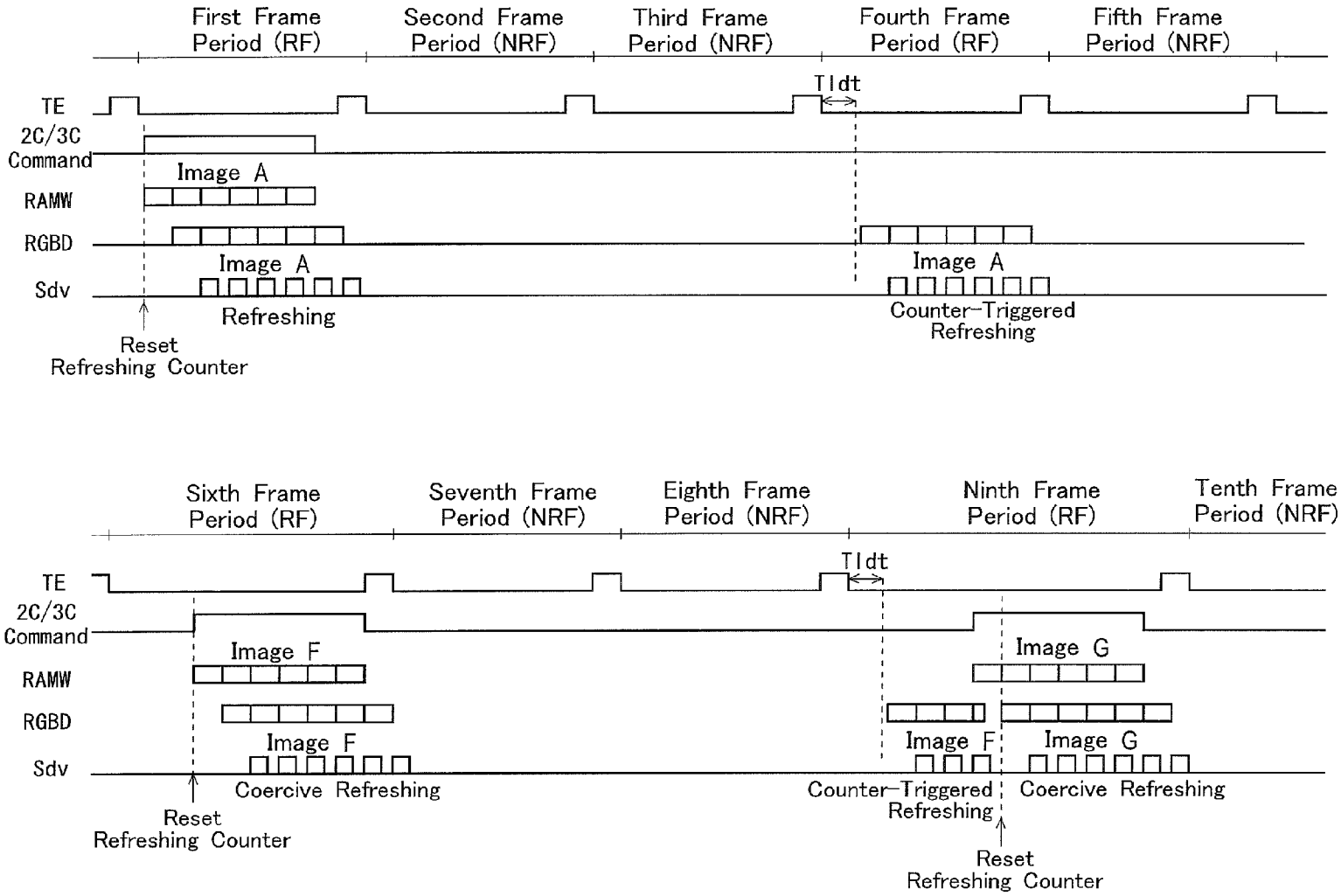
FIG. 12 is a timing chart of a second operation example (an operation example in the second asynchronous input handling mode) of the liquid crystal display device according to the second embodiment.

FIG. 11 is a timing chart which shows an operation example (hereinafter called the "first operation example") of a liquid crystal display device according to the present embodiment that performs a counter-triggered refreshing and a coercive refreshing as described above. In this example, data DAT from the host 1 is received in the first frame period in response to a request from the liquid crystal display device (from the display control circuit 200 thereof), whereby RAM write-data RAMW are inputted as an image data. Also, in the sixth frame period and the ninth frame period, there is a new input of RAM write-data RAMW as new image data asynchronously from the host 1. FIG. 11 shows, from the top, the transmission control signal TE; a 2C/3C command; a signal which indicates RAM write-data RAMW that are image data to be written into the frame memory 280 (thus, this signal will also be indicated as "RAMW"); RGB data RGBD which are read from the frame memory 280 and latched by the latch circuit 240 (thus, this signal will also be indicated as "RGBD"); and a driving image signal Sdv (the same will apply to FIG. 12 which will be described later). In FIG. 11, the transmission control signal TE is a positive logic (Hi-active) signal (the same will apply to FIG. 12 which will be described later). Note also that although the liquid crystal display device is AC driven and therefore the driving image signal Sdv has its polarity switched in a predetermined cycle, none of FIG. 11 and FIG. 12 shows this polarity change in the driving image signal Sdv. The polarity switching of driving image signal Sdv for AC driving is performed in the same arrangement and operation as in the first embodiment, so description will not be repeated (see FIG. 7).

At the beginning of the first frame period in FIG. 11, the timing generator 230 sends to the host 1 a transmission control signal TE. Upon reception of the active transmission control signal TE, the host 1 sends to the liquid crystal display device a 2C/3C command which contains RAM write-data RAMW as image data representing an image A, in synchronization with a fall of the transmission control signal TE. Once the 2C/3C command is received in the liquid crystal display device, the RAM write-data RAMW contained in this command data CM are supplied to the frame memory 280 via the interface section 210 and the command register 220. In this process, the RAM write-data RAMW of the image A are written into the frame memory 280 (the RAM therein) according to a control signal sent from the timing generator 230 to the frame memory 280.

In the first frame period, after the writing of the RAM write-data RAMW of the image A into the frame memory 280 is started, a control signal is sent from the timing generator 230 to the frame memory 280; and this initiates reading of the RAM write-data RAMW of the image A which have been written into the frame memory 280, as RGB data RGBD. The read RGB data RGBD are supplied to the latch circuit 240, and temporarily stored at the latch circuit 240 according to a control signal supplied from the timing generator 230 to the latch circuit 240. These retained RGB data RGBD are outputted, together with a timing signal for the signal lines generated by the signal line control signal output section 260 based on a control signal from the timing generator 230, as a signal line control signal SCT from the signal line control signal output section 260, and supplied to the signal line drive circuit 300. Also, based on a control signal from the timing generator 230, a timing signal for the scanning lines which is generated by the scanning line control signal output section 270 is outputted from the scanning line control signal output section 270 to the scanning line drive circuit 400 as a scanning line control signal GCT. The signal line drive circuit 300 drives the signal lines SL of the display section 100 based on the signal line control signal SCT while the scanning line drive circuit 400 drives the scanning lines GL of the display section 100 based on the scanning line control signal GCT, whereby pixel data, each corresponding to part of an image represented by the RGB data RGBD, are written to corresponding pixel formation portions 110 of the display section 100. Thus, based on the RAM write-data RAMW of the image A which is newly inputted from the host 1, a refreshing is performed on the display image in the display section 100. Upon execution of the refreshing, the count in the counter 35*a* is reset to "0", and then incremented by 1 when entering the next frame period (the second frame period). Specifically, as shown in FIG. 11, the count in the counter 35*a* is reset at a time point when writing of the RAM write-data RAMW into the frame memory 280 is started, and then incremented at a falling point of the transmission control signal TE which assumed H level (active) for a predetermined period after the writing.

As described above, the display control circuit 200 according to the present embodiment differs from the display control circuit 200 according to the first embodiment in that it: sends to the host 1 the transmission control signal TE in place of the vertical synchronization output signal VSOUT; receives from the host 1 the data DAT which contain the command data CM of the 2C/3C command in place of the data DAT which contain the vertical synchronization signal VSYNC, the horizontal synchronization signal HSYNC, the data enable signal DE, and the RGB data RGBD as image data; and writes to the frame memory 280 the RAM write-data RAMW as the image data which are contained in the command data CM in the 2C/3C command in place of the RGB data RGBD contained in the data DAT. However, aside from these differences, the display control circuit 200 in the present embodiment operates in the same way as the display control circuit 200 in the first embodiment. Thus, if these differences are kept in mind, it will become obvious from the description of the first operation example (FIG. 3) in the first embodiment and from FIG. 11 which illustrates the first operation example, how the liquid crystal display device in the present embodiment will operate in the first asynchronous input handling mode. Therefore detailed description will not be made for FIG. 11.

Again, in the present embodiment, upon asynchronous reception of the 2C/3C command out of the timing of the transmission control signal TE during a refreshing period in the first asynchronous input handling mode (i.e., if there is an asynchronous input of RAM write-data RAMW which are an image data contained in the command data of the 2C/3C command), a coercive refreshing is performed based on the inputted image data after completion of the counter-triggered refreshing which is underway in the refreshing period (see operation in the ninth frame period FIG. 11).

<2.2.2 Second Operation Example>

FIG. 12 is a timing chart showing an operation example in the second asynchronous input handling mode (hereinafter called the "second operation example") of the liquid crystal display device according to the present embodiment. In this example again, data DAT are received from the host 1 in the first frame period in response to a request from the liquid crystal display device (from the display control circuit 200 thereof) whereby RAM write-data RAMW are inputted as image data; and an asynchronous input of the RAM write-data RAMW as new image data is made in the sixth frame period and the ninth frame period. In the second operation example, operations of each component are identical with those in the above-described first operation example, except for those in the ninth frame period. Also, like in the first operation example, if the differences mentioned earlier are kept in mind, it is obvious from the description of the second operation example (FIG. 4) in the first embodiment and from FIG. 12 which illustrates the second operation example in the present embodiment, how the liquid crystal display device according to the present embodiment will operate in the second asynchronous input handling mode. Therefore, detailed description will not be made for FIG. 12.

Again, in the present embodiment, upon asynchronous reception of the 2C/3C command out of the timing of the transmission control signal TE during a refreshing period in the second asynchronous input handling mode (i.e., if there is an asynchronous input of RAM write-data RAMW which are image data contained in a command data of the 2C/3C command), the refreshing is aborted. In other words, the image data being used in the refreshing is not replaced with the new image data, and then, a coercive refreshing is performed based on the new image data (see operation in the ninth frame period FIG. 12).

<2.3 Configuration and Operation of Scanning Lines Drive Circuit>

Again in the present embodiment, in order to execute the above-described coercive refreshing in the second asynchronous input handling mode, it is necessary that the scanning line drive circuit 400 aborts its sequential application of active scanning signals G1 through Gn to the scanning lines GL1 through GLn, i.e., sequential selection of the scanning lines G11 through GLn (scanning of the display section 100), and de-activate all the scanning signals G1 through Gn, thereby bringing all the scanning lines GL1 through GLn into a de-selected state. To achieve this, the scanning lines drive circuit has the same configuration and performs the same operation as in the first embodiment and therefore, description will not be repeated here (see FIG. 5 and FIG. 6).

<2.4 AC Driving of Liquid Crystal Display Device>

The liquid crystal display device according to the present embodiment has the same configuration and does the same operation for AC driving, as the first embodiment, so no description will be repeated here (see FIG. 7).

<2.5 Advantages>

As will be understood from the description made thus far, the present embodiment provides the same advantages as does the first embodiment. Specifically, when there is an asynchronous input of new image data in an intermission driving liquid crystal display device which performs intermittent counter-triggered refreshing, the problem of tearing is prevented by execution of a coercive refreshing as described above, whereas updating of the display image is started immediately (within one frame period from the input of the new image data, at the latest). Therefore, it is possible to reduce delay in updating the display image and decrease in display quality at occasions when there is an asynchronous input of new image data, while reducing power consumption by means of the intermittent counter-triggered refreshing.

<2.6 Variations>

The variations possible for the first embodiment are also possible for the present embodiment. Since some of those variations possible for the present embodiment are already clear from those variations described for the first embodiment, no more description will be made here (see FIG. 7(C), FIG. 8, FIG. 9, etc.).

3. Others

In each of the embodiments described thus far, a liquid crystal display device is used as an example. However, the present invention is not limited by this, and is applicable also to other display devices such as organic EL (Electro Luminescence) display devices.

INDUSTRIAL APPLICABILITY

The present invention is applied to intermission driving display devices, and is particularly suitable for intermission driving liquid crystal display devices.

LEGEND

1 Host
2 Liquid crystal display device
10 Liquid crystal display panel
100 Display section
110 Pixel formation portion
111 TFT (Thin Film Transistor)
200 Display control circuit
210 Interface section
211 DSI receiver section
220 Command register
230 Timing generator
260 Signal line control signal output section
270 Scanning line control signal output section
280 Frame memory (RAM)
300 Signal line drive circuit
400 Scanning line drive circuit
SL Signal line
GL Scanning line
R Refreshing
N Non-refreshing

The invention claimed is:

1. A display device for display of an image represented by externally inputted image data, comprising:

a display panel that displays the image;

driving circuitry that drives the display panel;

a rewritable frame memory that stores the externally inputted image data; and control circuitry that controls the frame memory and the driving circuitry so as to write the externally inputted image data into the frame memory and to alternate between a refreshing period in which a display image is refreshed based on image data read out of the frame memory and a non-refreshing period in which the display image in the display panel is not refreshed; wherein when the display image is already starting to be refreshed based on the image data read out of the frame memory and new externally input image data, different from the image data read out of the frame memory, is written into the frame memory during the refreshing period, the control circuitry controls the frame memory and the driving circuitry so that the display image in the display panel is refreshed based on the new externally input image data before starting the next non-refreshing period.

2. The display device according to claim 1, wherein upon external input of the new externally input image data during the refreshing period, the control circuitry controls the frame memory and the driving circuitry so that a current frame period in which the new input of image data has been made is completed and thereafter the display image in the display panel is refreshed based on the new externally input image data before starting the next non-refreshing period.

3. The display device according to claim 2, wherein upon external input of the new externally input image data during the refreshing period, the control circuitry:

starts writing of the new externally input image data into the frame memory so that the writing of the new externally input image data into the frame memory is completed after completion of reading of image data from the frame memory made for the refreshing in the current frame period; and starts reading of the new externally input image data from the frame memory so that the writing of the new externally input image data into the frame memory is completed before completion of the reading of the new externally input image data from the frame memory.

4. The display device according to claim 1, wherein upon external input of the new externally input image data during the refreshing period, the control circuitry controls the frame memory and the driving circuitry so that the refreshing period is aborted and then started based on the new externally input image data.

5. The display device according to claim 4, wherein upon external input of the new externally input image data during the refreshing period, the control circuitry:

starts writing of the new externally input image data into the frame memory; and starts reading of the new externally input image data from the frame memory so that the writing of the new externally input image data into the frame memory is completed before completion of the reading of the new externally input image data from the frame memory.

6. The display device according to claim 1, wherein upon external input of new externally input image data during the non-refreshing period, the control circuitry controls the frame memory and the driving circuitry so that the non-refreshing period is aborted and then the refreshing period is started based on the new externally input image data.

7. The display device according to claim 6, wherein the display panel displays an image represented by the image data by application of voltage signals representing the image data stored in the frame memory while cyclically inverting polarity of the voltage signals, and wherein upon external input of the new externally input image data during the non-refreshing period, the control circuitry adjusts a length of the non-refreshing period which follows the refreshing of the display image in the display panel that is performed based on the new externally input image data so that the display panel has substantially an equal length of time for a period in which the voltage signals applied have positive polarity and for a period in which the voltage signals applied have negative polarity.

8. The display device according to claim 1, wherein the display panel includes:

a plurality of scanning lines;

a plurality of signal lines crossing the plurality of scanning lines; and a plurality of pixel formation portions arranged in a matrix pattern corresponding to the plurality of scanning lines and the plurality of signal lines;

the driving circuitry drives the plurality of scanning lines selectively, and drives the plurality of signal lines based on image data stored in the frame memory, each pixel formation portion including:

a switching element including a control terminal connected to a corresponding one of the scanning lines; and a predetermined capacitance connected to a corresponding one of the signal lines via the switching element.

9. The display device according to claim 8, wherein the switching element is provided by a thin film transistor including a channel layer made of an oxide semiconductor.

10. A driving method of a display device which includes a display panel that displays an image represented by externally inputted image data, the method comprising:

a storing step of writing the externally inputted image data into a predetermined frame memory; and a driving step of driving the display panel by alternation between a refreshing period in which a display image in the display panel is refreshed based on image data read out of the frame memory and a non-refreshing period in which the display image in the display panel is not refreshed, wherein the driving step includes: an asynchronous input driving step where, when the display image is already starting to be refreshed based on the image data read out of the frame memory and new externally input image data, different from the image data read out of the frame memory, is written into the frame memory during the refreshing period, the display panel is driven so that the display image in the display panel is refreshed based on the new externally input image data before starting the next non-refreshing period.

11. The driving method according to claim 10, wherein upon input of the new externally input image data during the refreshing period, the display panel is driven so that a current frame period in which the new externally input image data has been made is completed and thereafter the refreshing period is started based on the new externally input image data, in the asynchronous input driving step.

12. The driving method according to claim 10, wherein upon external input of the new externally input image data during the refreshing period, the display panel is driven so that the refreshing period is aborted and then started based on the new externally input image data, in the asynchronous input driving step.

13. The driving method according to claim 10, wherein the driving step further includes a step of driving the display panel, upon external input of the new externally input image data during a non-refreshing period, so that the non-refreshing period is aborted and then started based on the new externally input image data.

* * * * *